US005539433A

United States Patent [19]

Kawai et al.

[11] Patent Number: 5,539,433

[45] Date of Patent: Jul. 23, 1996

[54] RECORDING APPARATUS HAVING A RECORDING HEAD DRIVEN IN PLURAL BLOCKS

[75] Inventors: Jun Kawai, Tokyo; Ikumasa Ikeda; Hideo Takiguchi, both of Kawasaki, all of Japan

[73] Assignee: Canon Kabushiki Kaisha, Tokyo, Japan

[21] Appl. No.: 194,638

[22] Filed: Feb. 10, 1994

Related U.S. Application Data

[63] Continuation of Ser. No. 867,058, Apr. 10, 1992, abandoned, which is a continuation of Ser. No. 599,883, Oct. 19, 1990, abandoned.

[30] Foreign Application Priority Data

| | | | |
|---|---|---|---|
| Oct. 19, 1989 | [JP] | Japan | 1-270370 |
| Nov. 6, 1989 | [JP] | Japan | 1-287436 |
| Nov. 6, 1989 | [JP] | Japan | 1-287438 |
| Feb. 2, 1990 | [JP] | Japan | 2-022203 |

[51] Int. Cl.[6] ..... B41J 2/05; B41J 2/355

[52] U.S. Cl. ..... 346/141; 347/15; 347/182; 347/183

[58] Field of Search ..... 347/12, 13, 180, 347/181, 182, 15, 183

[56] References Cited

U.S. PATENT DOCUMENTS

| | | | |
|---|---|---|---|
| 4,300,144 | 11/1981 | Isayama | 347/12 |
| 4,313,124 | 1/1982 | Hara . | |
| 4,345,262 | 8/1982 | Shirato et al. . | |
| 4,353,079 | 10/1982 | Kawanabe . | |
| 4,355,319 | 10/1982 | Takeuchi | 347/180 |
| 4,459,600 | 7/1984 | Sato et al. . | |
| 4,463,359 | 7/1984 | Ayata et al. | 347/56 |
| 4,536,771 | 8/1985 | Tanaka | 346/76 PH |
| 4,558,333 | 12/1985 | Sugitani et al. . | |
| 4,639,741 | 1/1987 | Inoue | 347/182 |
| 4,661,825 | 4/1987 | Tsuchihashi | 347/182 |
| 4,723,129 | 2/1988 | Endo et al. | 347/56 |
| 4,738,553 | 4/1988 | Uemura et al. | 347/181 X |
| 4,740,796 | 4/1988 | Endo et al. | 347/56 |
| 4,973,984 | 11/1990 | Sasaki | 346/76 PH |
| 5,038,154 | 8/1991 | Yamamoto | 346/76 PH |
| 5,075,698 | 12/1991 | Aoki | 347/15 X |
| 5,172,130 | 12/1992 | Takahashi | 347/13 |

FOREIGN PATENT DOCUMENTS

| | | | |
|---|---|---|---|
| 0142964 | 7/1985 | European Pat. Off. | B41J 3/20 |
| 59-123670 | 7/1984 | Japan | B41J 3/04 |
| 59-138461 | 8/1984 | Japan | B41J 3/04 |
| 61-29272 | 5/1985 | Japan | H04N 1/40 |
| 60-132771 | 2/1986 | Japan | B41J 3/20 |

OTHER PUBLICATIONS

Eur. Pat. Off. Search Rep. for Eur. Pat. App. 90120016.2.

*Primary Examiner*—Joseph W. Hartary

*Attorney, Agent, or Firm*—Fitzpatrick, Cella, Harper & Scinto

[57] ABSTRACT

There is disclosed a driving device for a recording head such as a thermal head or an ink jet head driven in plural blocks, which is capable of avoiding formation of division lines, or low-density streaks, in the recorded image at the boundaries of the driving blocks of the head. In this driving device, the time difference between the start of pulse application to a heat generating element of the recording head and that of an adjacent element is maintained so as not to exceed the maximum pulse duration to the heat generating element. Also, a group of plural heat generating elements positioned at the boundary of two divided blocks is activated simultaneously with each of the two divided blocks.

8 Claims, 29 Drawing Sheets

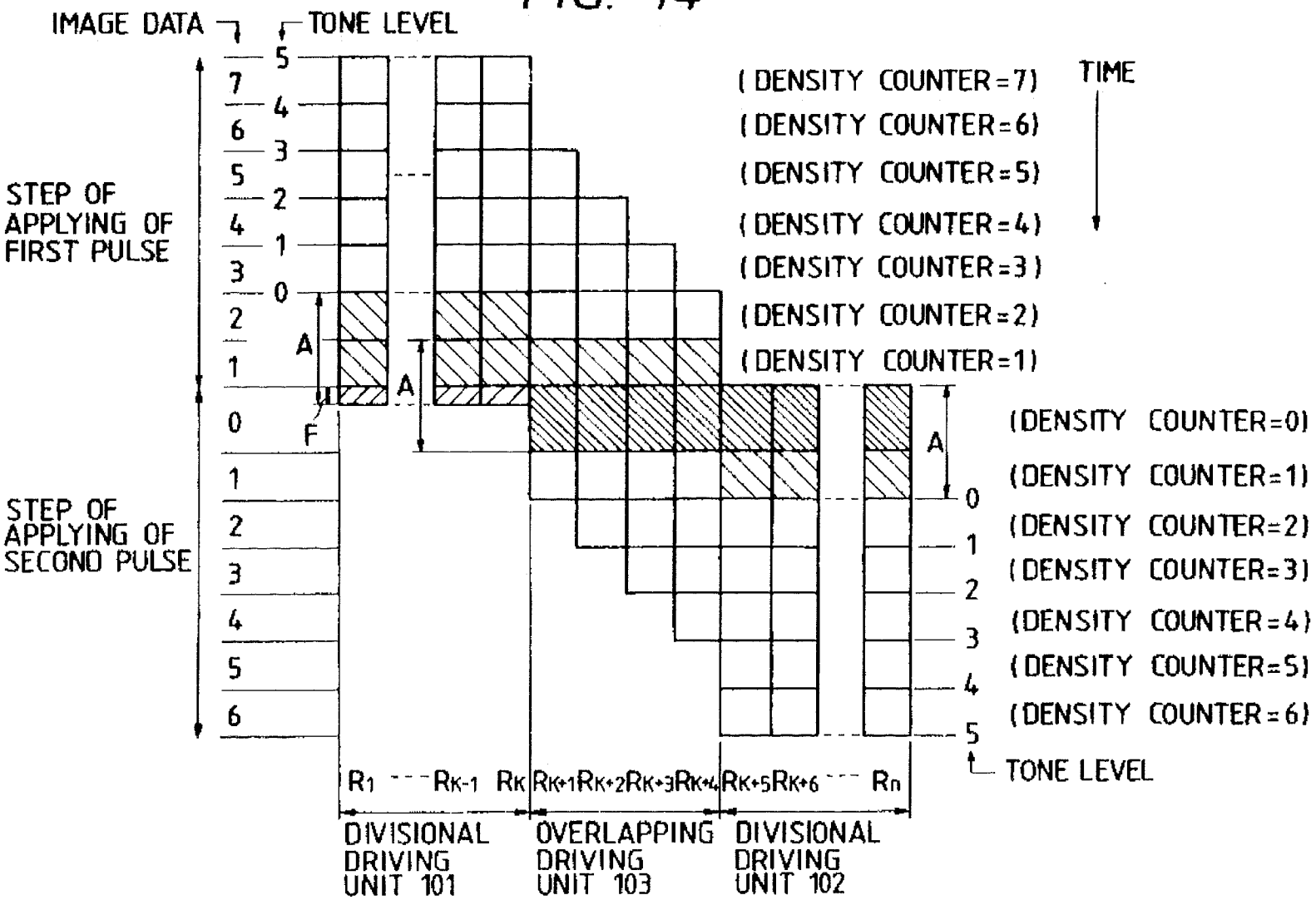
FIG. 14
IMAGE DATA
TONE LEVEL
STEP OF APPLYING OF FIRST PULSE
STEP OF APPLYING OF SECOND PULSE
(DENSITY COUNTER=7)
(DENSITY COUNTER=6)
(DENSITY COUNTER=5)
(DENSITY COUNTER=4)
(DENSITY COUNTER=3)
(DENSITY COUNTER=2)
(DENSITY COUNTER=1)
(DENSITY COUNTER=0)
(DENSITY COUNTER=1)
(DENSITY COUNTER=2)
(DENSITY COUNTER=3)
(DENSITY COUNTER=4)
(DENSITY COUNTER=5)
(DENSITY COUNTER=6)
TIME
TONE LEVEL
A
F
R1 --- Rk-1 Rk Rk+1 Rk+2 Rk+3 Rk+4 Rk+5 Rk+6 --- Rn
DIVISIONAL DRIVING UNIT 101
OVERLAPPING DRIVING UNIT 103
DIVISIONAL DRIVING UNIT 102

IMAGE DATA
TONE LEVEL
TIME
STEP OF APPLYING OF FIRST PULSE
STEP OF APPLYING OF SECOND PULSE
A
71
72
R1 --- Rk-1 Rk
DIVISIONAL DRIVING UNIT 101
Rk+1 Rk+2 Rk+3 Rk+4
OVERLAPPING DRIVING UNIT 103
Rk+5 Rk+6 --- Rn
DIVISIONAL DRIVING UNIT 102
TONE LEVEL

RECORDING APPARATUS HAVING A RECORDING HEAD DRIVEN IN PLURAL BLOCKS

This application is a continuation of application Ser. No. 07/867,058 filed Apr. 10, 1992, abandoned which is a continuation of application Ser. No. 07/599,883 filed Oct. 19, 1990 abandonded.

BACKGROUND OF THE INVENTION

1. Field of the Invention

The present invention relates to a driving device for driving a recording head provided with plural heat generating elements by dividing the head into plural blocks each having plural heat generating elements, and a recording apparatus provided with the driving device.

2. Related Background Art

In a thermal printer equipped with a line type thermal head, the printing characteristics are often influenced by the temperature of the thermal head. For this reason, the heat generating elements of the thermal head are driven in plural blocks, in order to prevent a rapid temperature increase of the entire thermal head, thereby avoiding rapid fluctuation in printing characteristics. This type of divided drive offers the advantage of reducing the capacity of the power source needed for driving the thermal head, as the electric power used in driving the thermal head can be reduced.

FIG. 28 shows the timing of conventional pulse application in solid black printing, in which a first pulse activates the heat generating elements of a divided block driver 201, and a second pulse activates those of another driver 202.

However, such divided drive results in portions of lower print density, so-called division lines, at the boundaries of the recording blocks. This is because the heat generating elements ($R_k$, $R_{k+1}$) at the boundary of the blocks are lower in temperature, as they are always at the end of energized blocks and are subjected to heat dissipation from the ends, thus resulting in a lower recording density.

For avoiding the formation of such division lines, various methods have been proposed, such as a method of applying a correcting coefficient to the recording data at the ends of each divided block as disclosed in the Japanese Patent Application Laid-open No. 60-132771, or a method of using an element at the boundary of two divided blocks in common for the blocks, as disclosed in the Japanese Patent Application Laid-open No. 61-29272. However, even with these methods, division lines are formed at the boundaries of the blocks of the recorded image, detracting from the quality of the image, depending on the ambient temperature or the increase or decrease of the temperature, or depending on the tonal rendition of the image.

SUMMARY OF THE INVENTION

In consideration of the foregoing, an object of the present invention is to provide an improved driving device for the recording head and a recording apparatus equipped with the driving device.

Another object of the present invention is to provide a driving device for the recording head, capable, in driving the plural heat generating elements of the recording head in plural blocks, of preventing the formation of division lines by difference in density at the boundaries of the blocks, thereby forming high quality images, and a recording apparatus equipped with the driving device.

Still another object of the present invention is to provide a driving device for the recording head, capable of reducing the capacity of the power supply for driving the plural heat generating elements of the recording head in plural blocks, and a recording apparatus equipped with the driving device.

The foregoing and still other objects of the present invention, and the advantages thereof, will become fully apparent from the following description which is to be taken in conjunction with the attached drawings.

BRIEF DESCRIPTION OF THE DRAWINGS

FIGS. 14 and 15 are timing charts showing pulse application in a fourth embodiment;

FIG. 26-1 and 26-2 are flow charts showing the control sequence of the sixth embodiment;

DETAILED DESCRIPTION OF THE PREFERRED EMBODIMENTS

Now the present invention will be explained in detail by embodiments thereof shown in the attached drawings.

Figure 1:
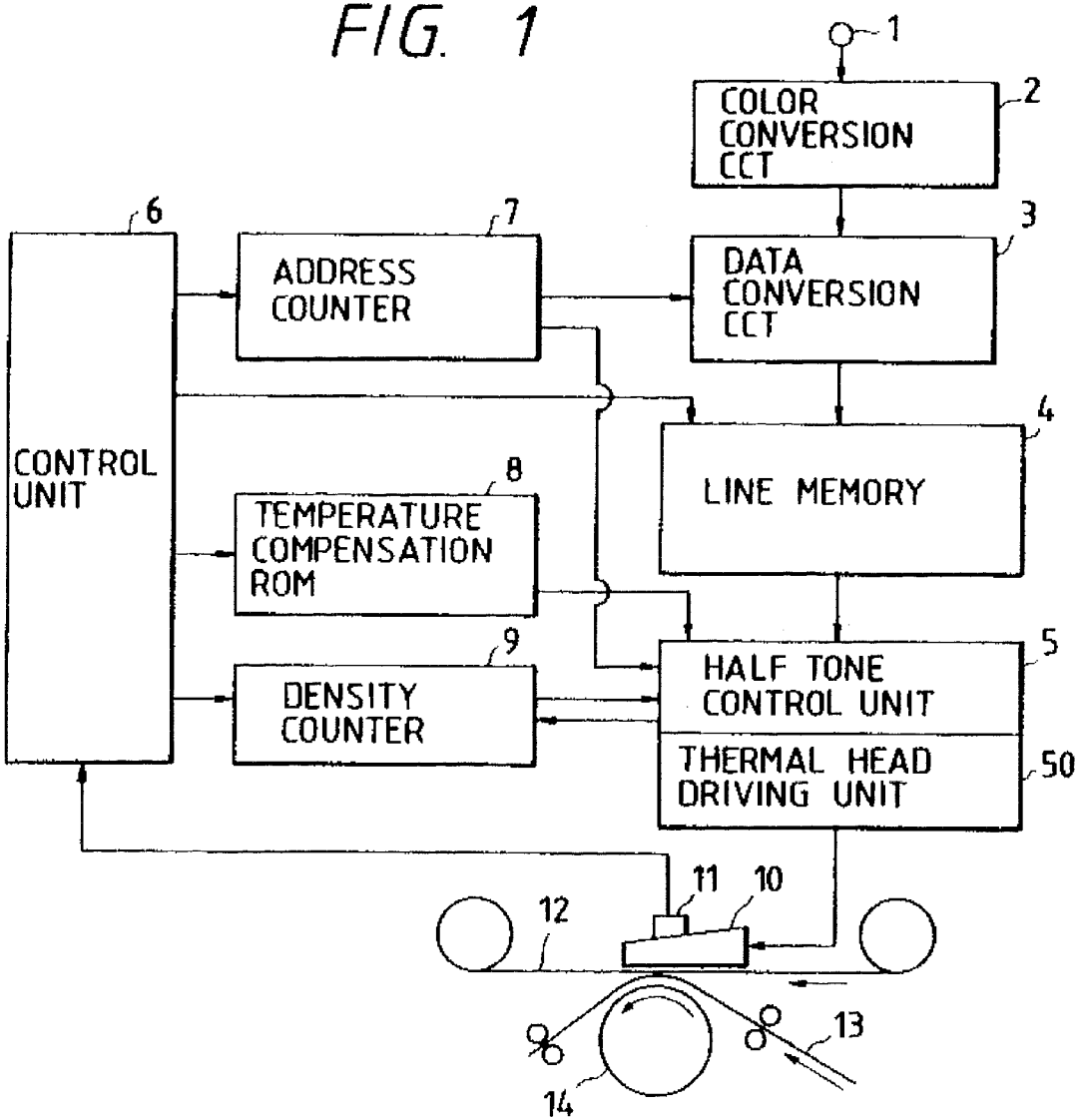
FIG. 1 is a block diagram of a thermal printer constituting a first embodiment of the present invention.
Figure 2:
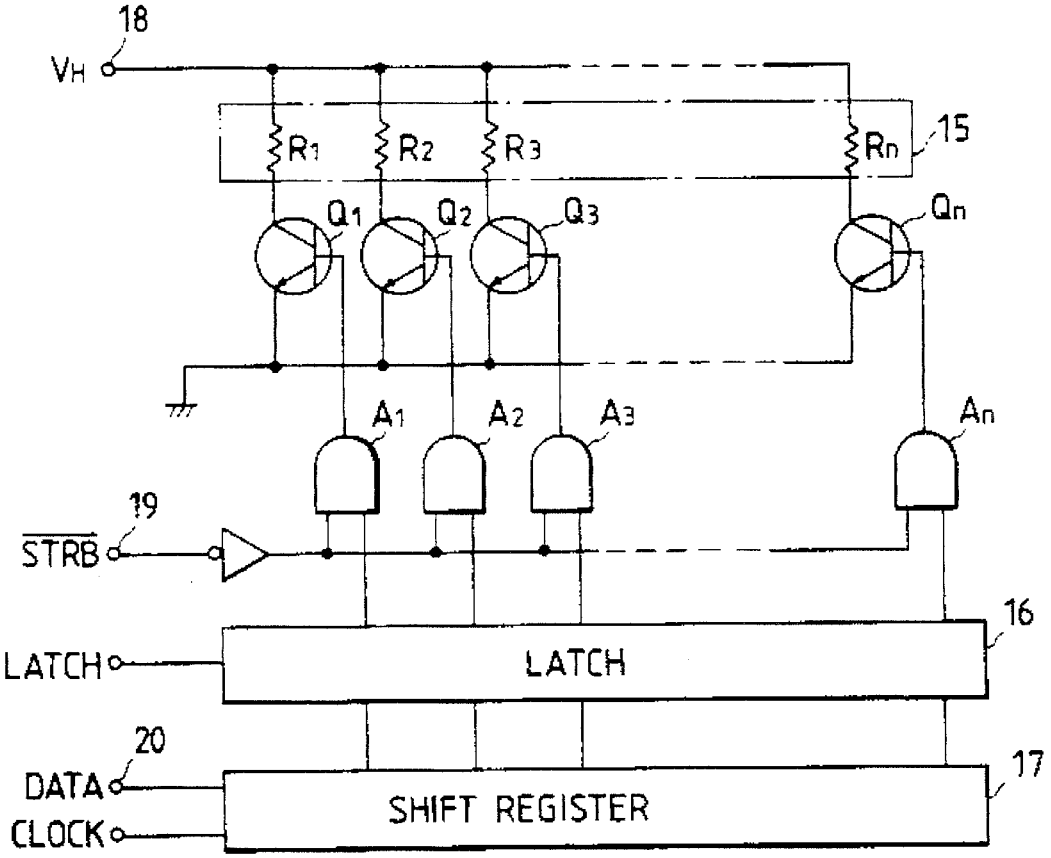
FIG. 2 is a block diagram showing the details of the thermal head driving unit shown in FIG. 1.

FIGS. 1 and 2 illustrate an embodiment of the present invention, wherein FIG. 1 is a block diagram of a thermal printer constituting the embodiment while FIG. 2 is a block diagram of the thermal head driving unit 50 in a halftone control unit 5 shown in FIG. 1.

In these drawings there are shown an input terminal 1 for receiving color image data of red, green and blue, from a host apparatus connected thereto; a color conversion circuit 2 for converting the color signals for R, G, B into corresponding color signals of yellow (Y), magenta (M) and cyan (C); a data conversion circuit 3 for data conversion according to the positions of heat generating elements; a line memory 4 for storing data of a line; a halftone control circuit 5 for controlling the energy supplied to a thermal head 10 for reproducing halftone of the color image, and including a thermal head driving unit 50; a control unit 6 for controlling the entire thermal printer; an address counter 7 for counting the position of heat generating elements; a temperature compensation ROM 8 storing data for determining the tonal level according to the temperature around the thermal head for each color of ink sheet; a density counter 9 for storing tonal data and counting the number of strobe signals for energizing the thermal head in comparison with recording data; a thermal head 10 having a linear array of plural heat-generating resistor elements; a temperature detector 11 for detecting the head temperature; an ink sheet 12; a receiving or recording sheet 13; and a platen roller 14.

Referring to FIG. 2, there is shown a linear array 15 of plural heat-generating resistor elements; latch circuit 16 respectively corresponding to the plural heat generating elements and used for latching recording data corresponding to the heat generating elements; a shift register 17 for receiving halftone recording data (serial DATA) in synchronization with CLOCK signals; a common electrode 18, an input terminal 19 for a strobe signal STRB for defining the timing of energization of the heat generating elements; an input terminal 20 for serial data signal DATA: and AND gates $A_1$–$A_n$ which respectively turn on transistors $Q_1$–$Q_n$ corresponding to the recording data and in synchronization with the strobe signal STRB, thereby energizing the corresponding heat generating elements.

On the ink sheet 12, ink portions of Y, M and C are repeated in the transporting direction, in a predetermined cyclic sequence, and the length of each ink portion corresponds to the length of the recording sheet 13 in the transporting direction. At each boundary of the ink portions there are provided data indicating the kind of ink, for example by a bar code, and the position of each ink portion can be identified by reading the bar code with a sensor (not shown).

Figure 3:
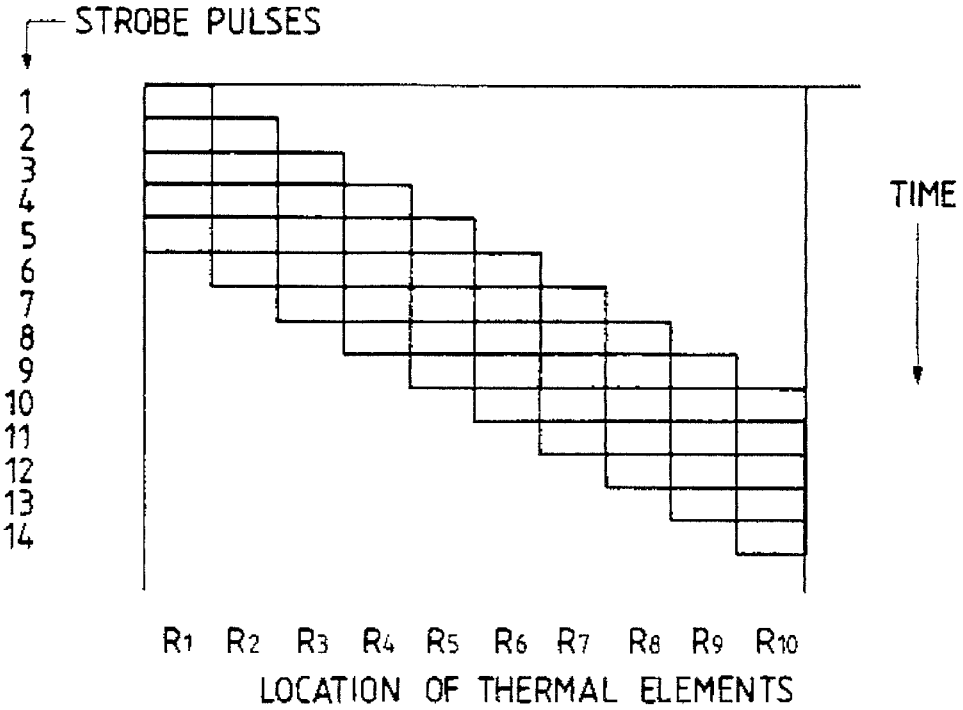
FIG. 3 is a timing chart showing the pulse application in the heat generating elements in solid black printing in the first embodiment.

In case of recording a color image, the recording sheet 13 is transported to a recording position shown in FIG. 3, and a color image is formed by means of ink portions of Y, M and C.

In the following there will be explained the function of the above-explained embodiment.

B, G and R signals are entered from the unrepresented host apparatus to the input terminal 1, in succession corresponding to the order of printing of Y, M and C colors. The input signals are converted into corresponding Y, M and C signal in the color conversion circuit 2, and the signals obtained are transmitted to the data conversion circuit 3, in the unit of each printing line. The data conversion circuit 3 converts the received data of a line into data of each heat generating resistor element designated by the address counter 7, and stores the data in the line memory 4. Thus stored data for respective heat generating elements are read by a predetermined number of times (14 times in the present embodiment) from the memory 4 in synchronization with the print timing of the respective heat generating elements, and transferred to the halftone control unit 5. Simultaneously with a print start signal for each line, a strobe pulse number "1" is set in the density counter 9, and the count is step increased at each data readout from the line memory 4 until the count reaches "14".

The halftone control unit 5 compares the data of a line obtained from the line memory 4, starts energization of a heat generating element of a position $R_k$, having data to be printed, at a timing $k \leqq$ strobe pulse number, and terminates energization when a condition strobe pulse number<input data+k is reached.

The amount of energy supplied by the thermal head driving unit 50 to the heat generating element 15 of the thermal head is controlled according to the data stored in the temperature compensation ROM, and a strobe signal of a corresponding duration is transferred from the halftone control unit 5 to the strobe signal input terminal 19 of the thermal head driving unit 50. The strobe signal consists of 14 pulses of a predetermined duration corresponding to the energy to be generated by the heat generating element 15, synchronized with the data transfer from the line memory 4.

The data signals subjected to density control in the halftone control unit 5 and supplied to the thermal head driving unit 50 as explained above are converted into parallel signals in the shift register 17, latched in the latches 16, at the same time supplied to the AND gates $A_1$–$A_n$, and further supplied to the gates of the heat generating elements corresponding to a density level in a line. Thus logic summing is made with the strobe signal, and the heat generating elements 15 which are to effect printing of the density level are activated for the duration of the strobe signal.

In the present embodiment the heat generation is conducted once for a density level, or five times for five density levels.

Thus heat generation is repeated 14 times according to the print density of each heat generating element, thereby obtaining 5 levels in each line.

Corresponding to the thermal energy generated by the heat generating elements 15, sublimable or thermofusible ink coated on the ink sheet 12 sublimes or fuses and is transferred onto the receiving sheet 13, thereby forming an image.

FIG. 3 shows the timing of pulse applications in each heat generating element 15 in solid black recording of the present embodiment, wherein the abscissa indicates the positions of heat generating elements, while the ordinate indicates time and strobe pulse numbers.

FIG. 3 illustrates a case of solid black printing with a fifth level (maximum) density, in which immediately adjacent elements are driven with a time difference corresponding to a strobe pulse, and each of ten elements R1–R10 is activated 5 times corresponding to the maximum density.

Figure 4:
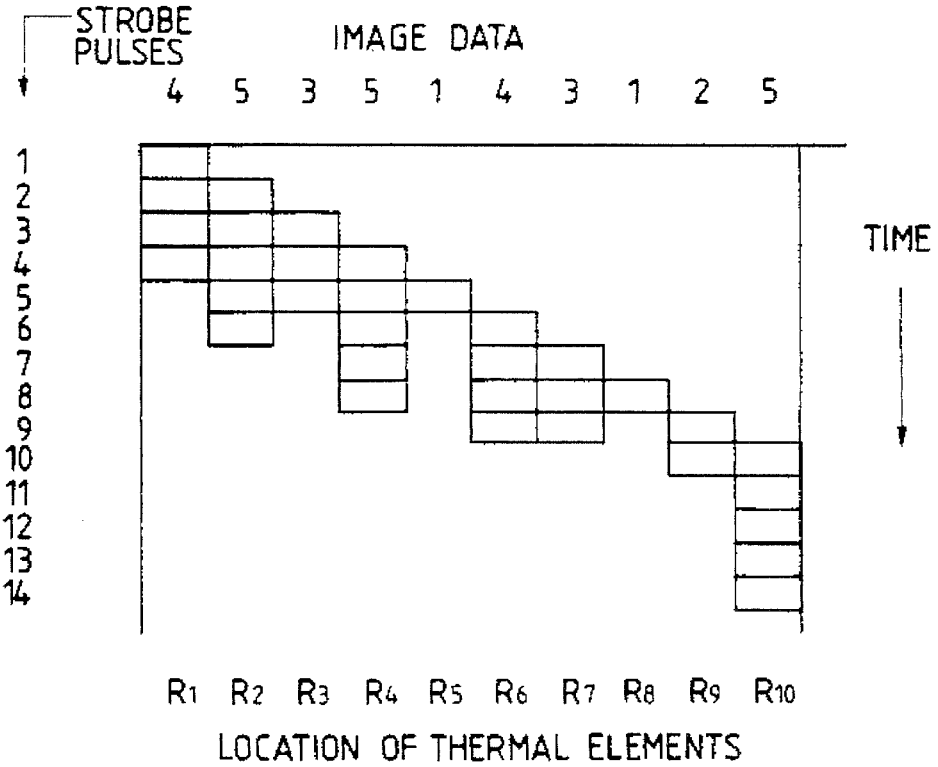
FIG. 4 is a timing chart showing the pulse application in the heat generating elements with ordinary image data in the first embodiment.

FIG. 4 illustrates the timing of pulse applications to the heat generating elements, in the case of ordinary image data, according to the driving method of the present embodiment.

The first pulse applied to each heat generating element is displaced by a time corresponding to a strobe pulse between the adjacent elements. Thereafter second, third and subsequent pulses are added according to the density level.

The above-explained control avoids temperature decreases in particular position, since there is no extreme time difference in the application of pulses between the adjacent pixels in cases of solid black printing or image data recording, thereby providing an image of high quality free from division lines. Also the maximum number of simultaneously activated elements does not exceed five, so that ordinary printing can be achieved with a power source of small capacity.

As explained in the foregoing, since the difference between the start time of pulse application to each heat generating element of the thermal head and that to the immediately adjacent element does not exceed the maximum duration of the pulse applied to such elements, there can be obtained an image of high quality without division lines using of a power source of limited capacity.

In the following there will be explained a second embodiment of the present invention, in which plural heat generating elements of the thermal head are driven in divided manner in two blocks, and plural heat generating elements positioned at the boundary of two blocks are superposedly driven at the activation of both blocks.

Figure 5:
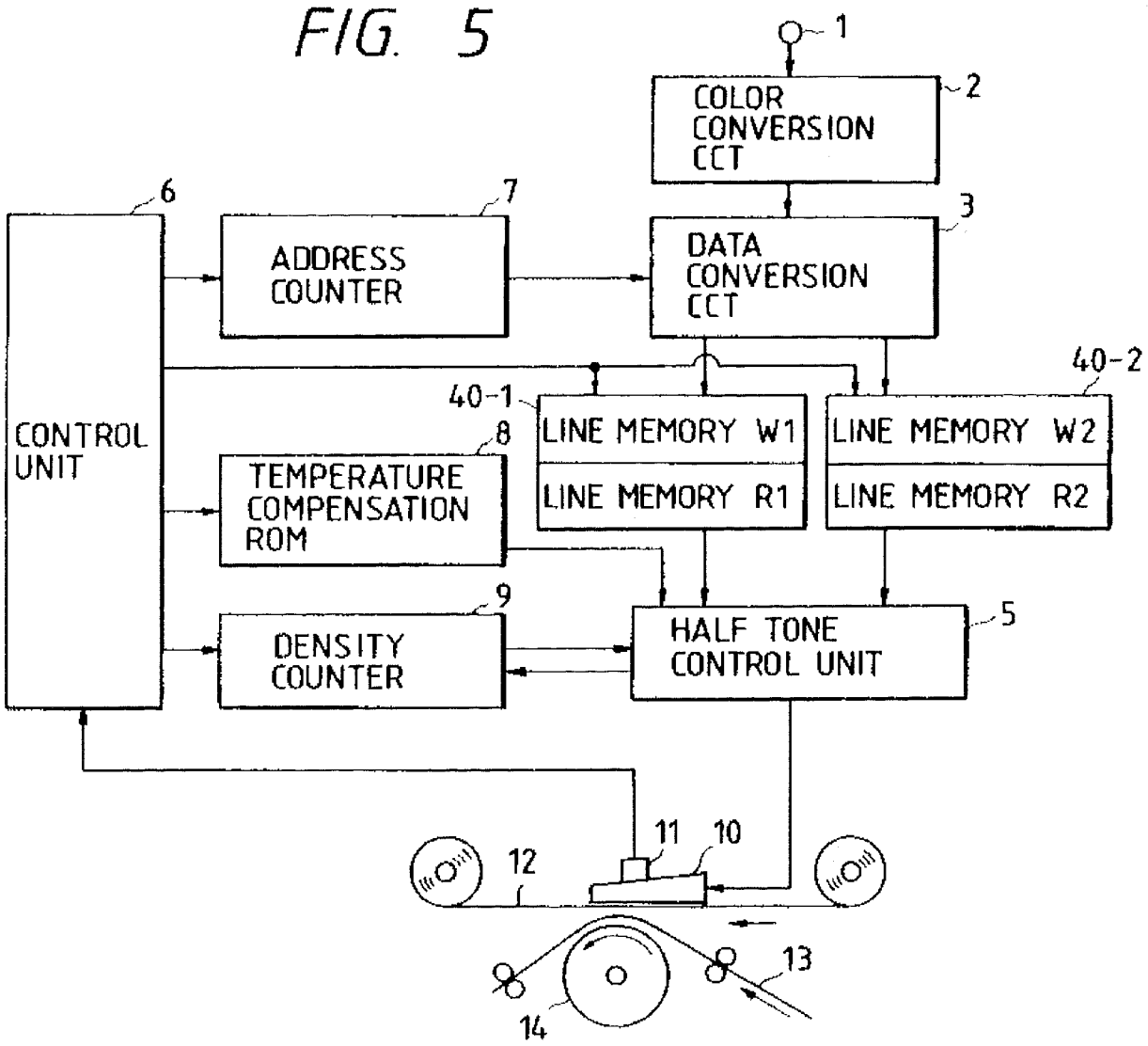
FIG. 5 is a block diagram of a thermal printer constituting second to fifth embodiments of the present invention.

FIG. 5 is a schematic block diagram of a thermal transfer printer constituting the present embodiment, wherein the same components as shown in FIG. 1 are represented by same numbers. There are also provided line memories 40-1, 40-2. The data conversion circuit 3 converts the image data according to the positions of the heat generating elements of the thermal head 10, and stores the image data of a line as data of two lines in the line memories 40-1, 40-2, corresponding to the block division (two blocks in this case) of the thermal head 10.

Figure 6:
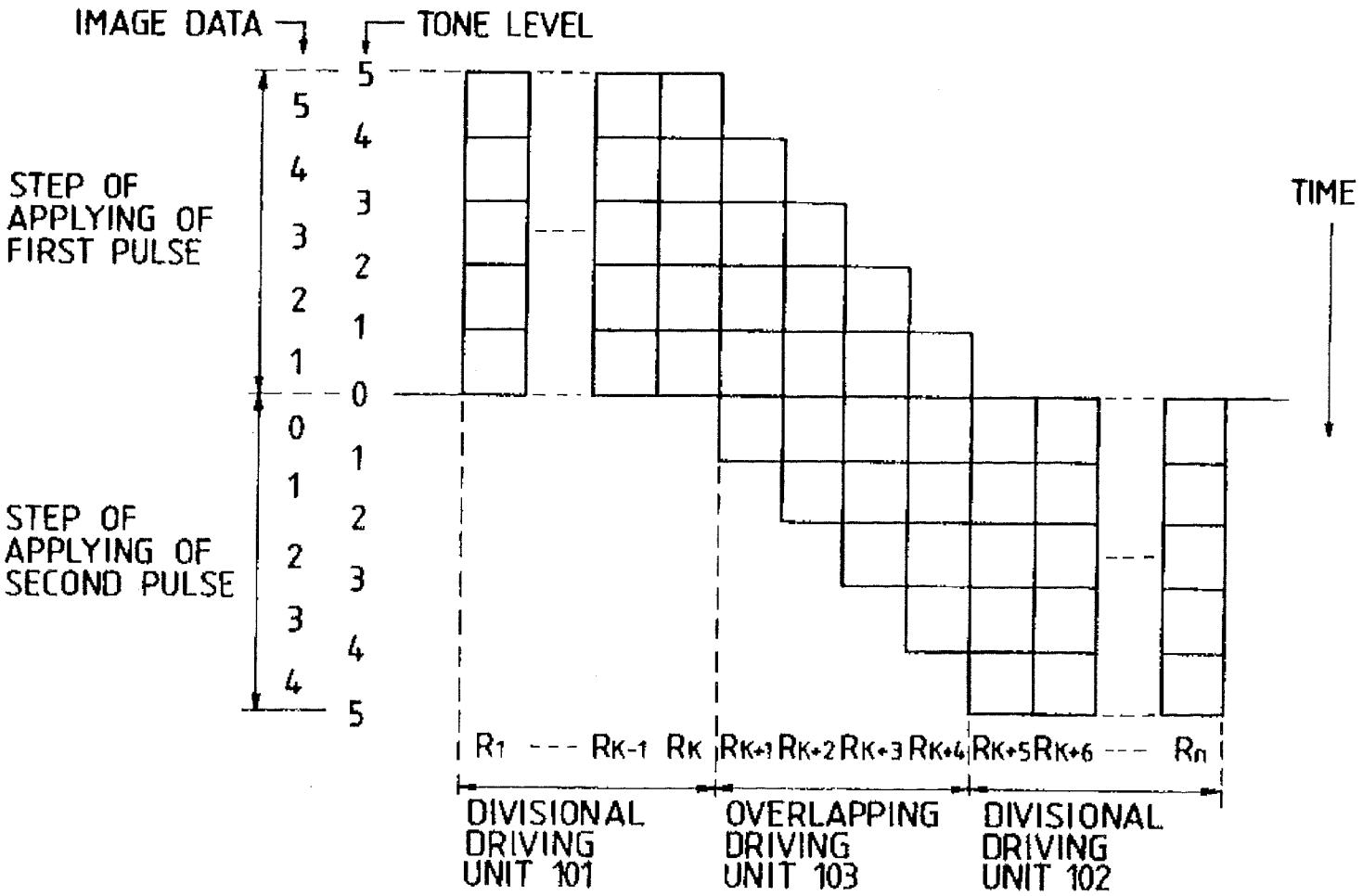
FIG. 6 is a timing chart showing pulse application in the heat generating elements in solid black printing in the second embodiment.

In the following there will be explained the function of the present embodiment, with reference to timing charts of pulse applications shown in FIGS. 6 and 7.

The input terminal 1 receives the B, G and R signals in succession, from a color image memory (not shown), corresponding to the order of printing of Y, M and C. The signals are converted by the color conversion circuit 2 into Y, M and C signals, and the obtained image data are transferred, in the unit of a print line, to the data conversion circuit 3. The image data of a line are divided according to predetermined proportions, for two pulse applying processes to be explained later, as the data for each heat generating element designated by the address counter 7, and thus divided data are respectively stored in two line memories W1, W2 in 40-1, 40-2.

The line data stored in these line memories W1, W2 are read by respectively corresponding line memories R1, R2. Then, in a first pulse applying process, the data of a line are read from the line memory R1 by a number of times corresponding to the number of levels (5 times in the present embodiment) and transferred to the halftone control unit 5. Then, in a second pulse applying process, the data are read from the line memory R2 by a number of times corresponding to the number of levels (5 times in the present embodiment) and are processed in a similar manner.

More specifically, at the start of the first pulse applying process, a value "5" corresponding to the number of levels is set in the density counter 9 simultaneous with the print start signal for each line. The halftone control unit 5 compares the image data of a line obtained from the line memory R1 with the value, and generates recording data "1" for each heat generating element for which the relation [image data] ≧5 (value of density counter 9) holds true. Thus serial binary data are supplied to the data input terminal 20 in order to energize the corresponding heat generating elements.

In each subsequent heat generating operation, the count of the density counter 9 is stepwise decreased, then the image data are compared with the count, and the heat generating elements satisfying the condition (image data≧4), (image data≧3), . . . are energized. Finally the data readout from the line memory R1 is terminated when the count of the density counter 9 becomes equal to "0".

Subsequently there is started the second pulse applying process. Data of a line are read from the line memory R2, and serial data are supplied to the data input terminal 20 so as to energize the heat generating elements at the positions satisfying the condition [image data]≧0. Then the density counter 9 is switched to an up counting operation, and comparisons [image data]≧1, [image data]≧2, . . . are conducted as explained above. In this manner there are generated data "1" for the corresponding elements to be energized. With the transfer of data satisfying a condition [image data]≧4, there are completed the data transfer and the image recording of a line with 5 density levels.

The amount of energy supplied to each heat generating resistor element of the thermal head 10 is controlled according to the data stored in the temperature compensation ROM 8, and a strobe signal STRB of a corresponding duration is supplied to the strobe input terminal 19 of the head driving circuit. The strobe signal is also divided into two pulse applying processes corresponding to two blocks, and ten strobe pulses in total are supplied corresponding to the number of levels.

In the above-explained operations, the data signals entered into the thermal head 10 are stored in the shift register 17, latched in the latch circuits 16 by a latch signal and are supplied to the AND gates $A_1$–$A_n$, whereby selected heat generating resistor elements 15 are activated for the duration of the strobe signal. This operation is repeated for the two pulse applying processes, namely ten times in total, thereby recording a line in five levels.

The sublimable or fusible ink coated on the ink sheet 12 sublimes or is fused by the thermal energy generated by the heat generating elements 15, and is transferred to the receiving sheet 13, thereby forming an image thereon.

In the following there will be explained the method of division of data of a line in the data conversion circuit 3.

Figure 7:
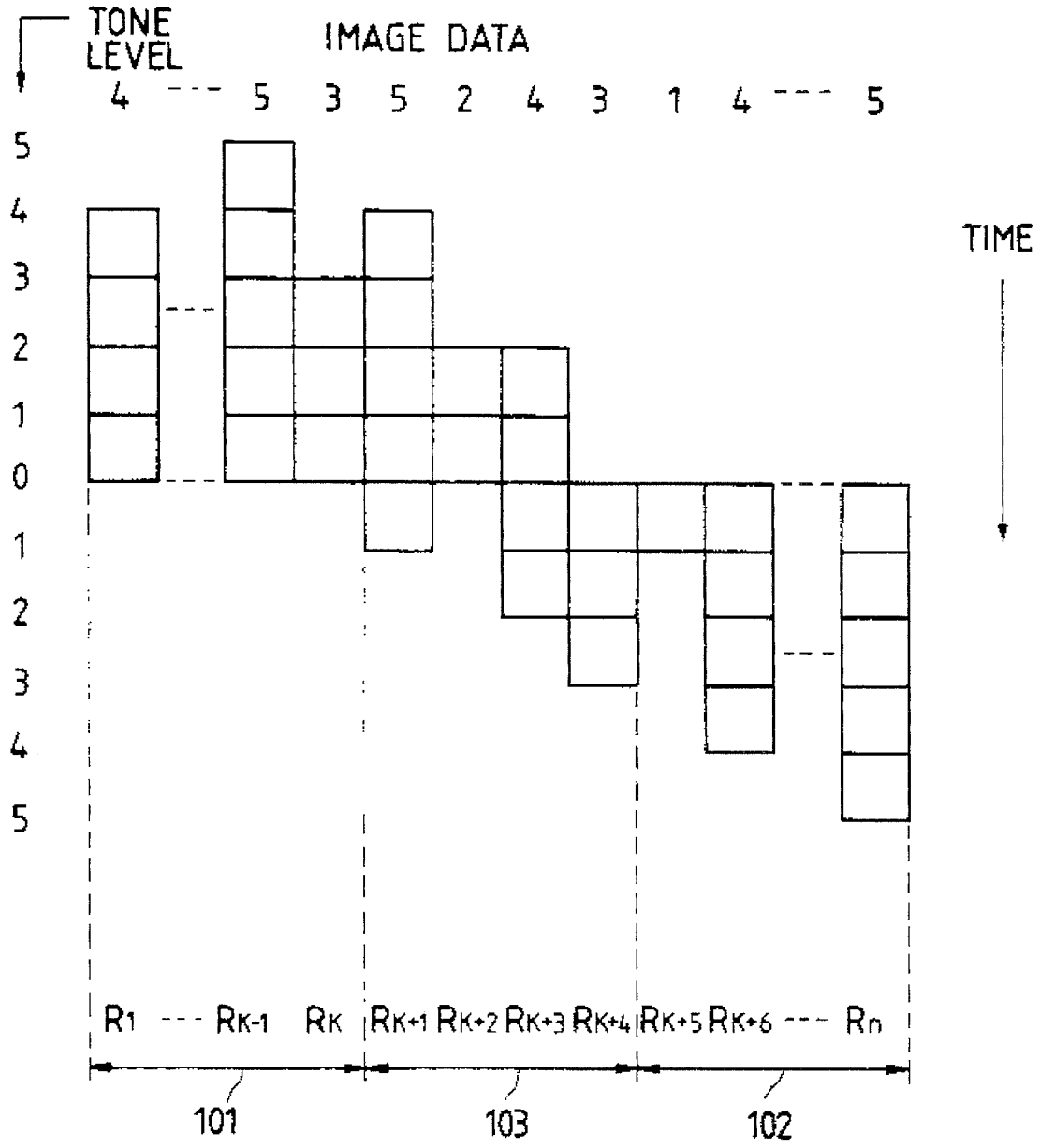
FIG. 7 is a timing chart showing pulse application in the heat generating elements in image data recording of the second embodiment.

FIG. 7 is a timing chart of the pulse application to the heat generating elements in solid black recording in the present embodiment, wherein the abscissa indicates the positions of the heat generating elements $R_1$–$R_k$, while the ordinate indicates time and density levels. In the present embodiment said heat generating elements are divided into two blocks, and four elements at the boundary of the blocks are activated simultaneously with the blocks on both sides. The upper and lower sides of the image data "0" are respectively called first pulse applying process and second pulse applying process (including image data "0"). Also the heat generating elements are numbered from left to right, as $R_1$–$R_k$ in the divided driving unit 101 at left, $R_{k+1}$–$R_{k+4}$ in four elements in the overlapped driving unit 103 at the center and $R_{k+5}$–$R_n$ in the divided driving unit 102 at right.

In the following there will be explained, with reference to FIG. 6, the case of solid black printing in which all the heat generating elements 15 effect recording with a level "5".

The data of the first pulse applying process are stored in the line memory W1 in 40-1, while those of the second pulse applying process are stored in the line memory W2 in 40-2. In case of solid black printing, the data stored in the line memory W in 40-1 are "5" for all the heat generating elements $R_1$–$R_k$ in the left block 101, and are "4", "3", "2" and "1" respectively for the elements $R_{k+1}$, $R_{k+2}$, $R_{k+4}$ in the overlapped driving unit 103. Also the image data are all "0" for the heat generating elements $R_{k+5}$–$R_n$ in the right block 102.

On the other hand, in the line memory W2 in 40-2, there are stored data "0" for all the heat generating elements $R_1$–$R_k$ of the left block 101, "1", "2", "3" and "4" respectively for the elements $R_{k+1}$, $R_{k+2}$, $R_{k+3}$ and $R_{k+4}$ of the overlapped driving unit 103, and "5" for all the elements $R_{k+5}$–$R_n$ of the right block 102.

Then the image data are read from the line memory R1 in 40-1, and the comparisons are made with stepwise decreased count of the density counter 9. Thus the obtained binary data are transferred to the thermal head 10. After the first pulse applying process in the thermal head 10 is completed in this manner, there is initiated the second pulse applying process, in which the image data are read from the line memory R2 in 40-2, repeatedly with stepwise increase of the count of the density counter 9 from "0" to "4".

The above-explained operations are to obtain solid black printing, by printing the image data of a line with the heat generating elements divided into plural blocks.

FIG. 7 shows the timing of pulse application to the heat generating elements for ordinary image data instead of solid black data. The image data corresponding to the heat generating elements of the overlapped driving unit are "5, 2, 4, 3" from left (element $R_{k+1}$) to right and these data are divided into two and stored in the line memories W1, W2. In the present embodiment, the data of the elements of the overlapped driving unit, stored in the memory W1, are "4, 2, 2, 0" from left to right, and those stored in the memory W2 are "1, 0, 2, 3" from left to right.

Figure 8:
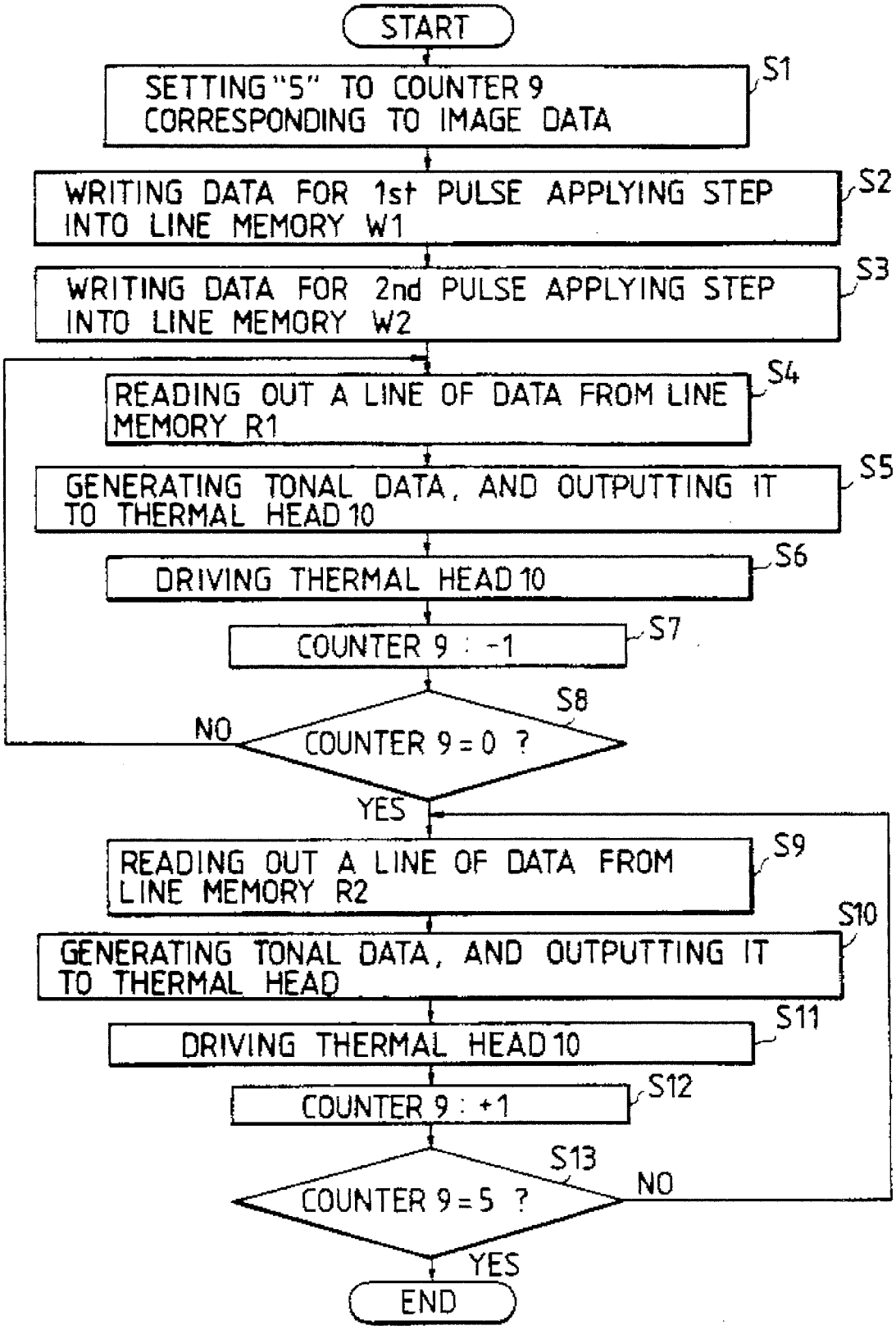
FIG. 8 is a flow chart showing the driving sequence for the thermal head of the second embodiment.

FIG. 8 is a flow chart showing the control sequence in the above-explained pulse application.

At first step S1 sets a value "5" in the density counter 9, corresponding to the value of the image data. Then step S2 stores the image data for the image pulse applying process in the line memory W1. For example, in case of solid black printing shown in the FIG. 6, there are stored data "5" for all the heat generating elements of the left block 101; "4, 3, 2, 1" for the elements of the overlapped driving unit 103; and "0" for all the elements in the right block 102. Then step S3 stores the image data for the second pulse applying process in the line memory W2. For example, in the case of solid black printing shown in FIG. 6, there are stored "0" for all the elements of the left block 101; "1, 2, 3, 4" for the elements of the overlapped driving unit 103; and "5" for all the elements of the right block 102.

The a step S4 reads the image data of a line to be recorded in the first pulse applying process from the line memory R1, and a step S5 effects comparison with the value of the density counter 9 and generates serial recording data, in which the signal is "1" for the heat generating element satisfying a condition [image data]≧[value of density], counter 9, for supply to the thermal head 11. Then a step S6 sends the strobe signal STRB to the thermal head 11, thereby activating the heat generating elements. Then a step S7 decreases the count of the density counter 9 by one, and a steps S4 to S8 are repeated until step S8 identifies that the count of the density counter 9*s* is equal to "0".

When the step S8 identifies that the count of the density counter 9 is "0", step S9 reads the image data of a line for the second pulse applying process from the line memory R2, and step S10 effects comparison with the count of the density counter 9 in a similar manner as in step S5, thereby determining the data to be supplied to the thermal head 11, and sends the data serially to the thermal head 11.

Figure 9:
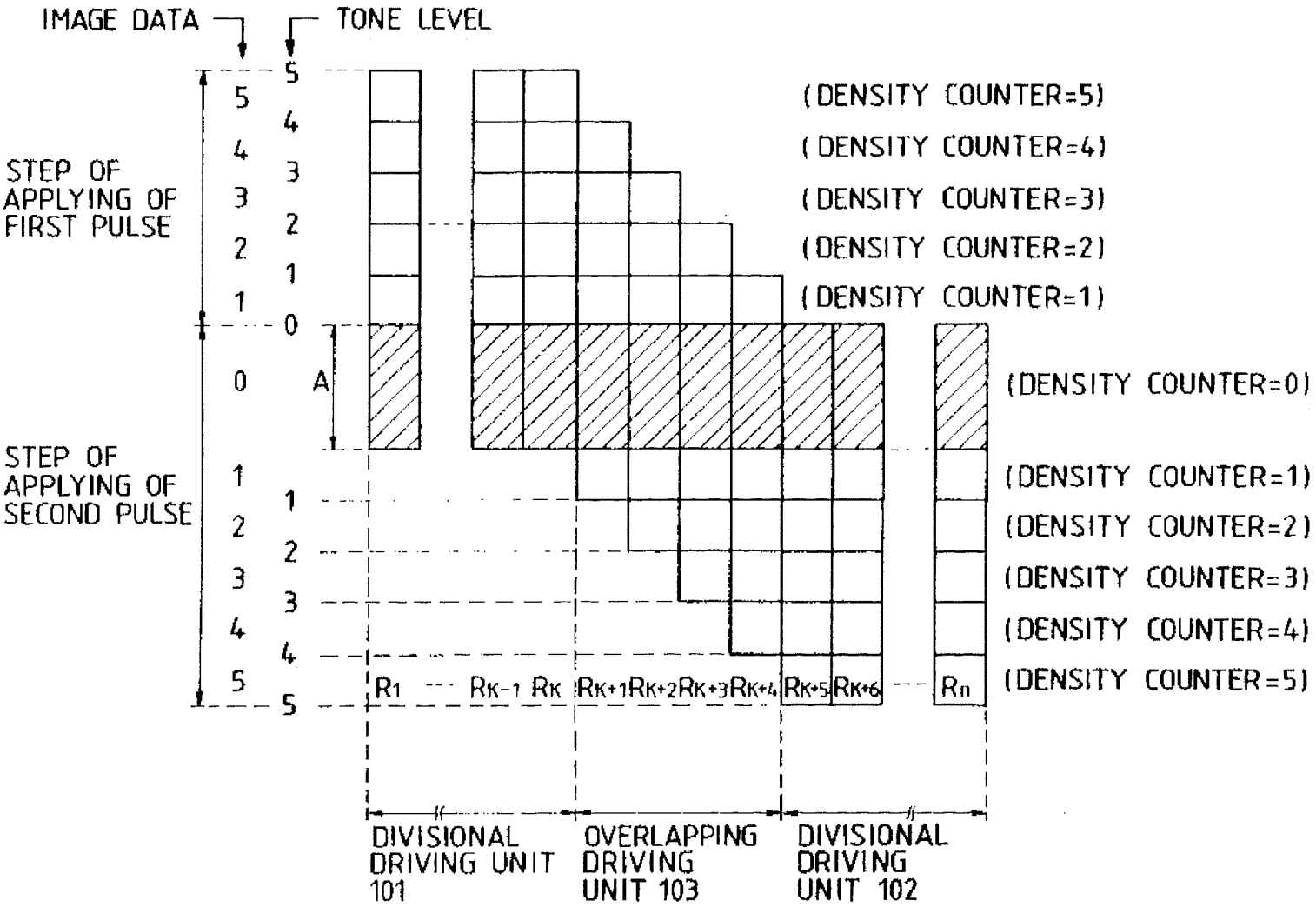
FIG. 9 is a timing chart showing pulse application in the heat generating elements in solid black printing of the third embodiment.

Step S11 releases the strobe signal STRB for activating the thermal head 10, in the same manner as in step S6. Then step S12 increases the count of the density counter 9 by one, and steps S9 to S13 are repeated until step S13 identifies that the count of the density counter 9 is equal to "5". FIG. 9 shows the timing of pulse applications to the thermal head 11 in the above-explained recording.

In the present embodiment, as explained in the foregoing, plural heat generating elements at the boundary of mutually adjacent blocks are activated twice in divided manner. Consequently there is no time difference in the pulse application at the boundary of adjacent blocks, and division lines are not formed in the recorded image.

In the following there will be explained a third embodiment of the present invention, in which a group of plural heat generating elements, positioned at the boundary of two adjacent divided blocks, is activated simultaneously with the first one of the two divided blocks, and also simultaneously with the second one of the two divided blocks, in such a manner that the energy applied to the group of heat generating elements at the boundary corresponds to the image data corresponding to the group of heat generating elements, whereby all the heat generating elements of the recording head are activated, at different times, corresponding to the image data. The circuit structure of the present embodiment will not be explained since it is same as that shown in FIG. 5.

The input terminal 1 receives the B, G and R signals in succession, from a color image memory (not shown), corresponding to the order of printing of Y, M and C. Signals are converted by the color conversion circuit 2 into Y, M and C signals, and the obtained image data are transferred, in the unit of a print line, to the data conversion circuit 3. The image data of a line are divided according to predetermined proportions, for two pulse applying processes to be explained later, as the data for each heat generating element designated by the address counter 7, and thus divided data are respectively stored in two line memories (W1, W2) 4.

The line data stored in these line memories (W1, W2) 4 are read from respectively corresponding line memories R1, R2. At first, the data of a line are read from the line memory R1 by a number of times corresponding to the number of levels (5 times in the present embodiment), and transferred to the halftone control unit 5. Then, in a second pulse applying process, similar operations are conducted (readings of 6 times in the present embodiment) with respect to the line memory R2.

More specifically, at the start of the first pulse applying process, a value "5" corresponding to the number of levels is set in the density counter 9 simultaneous with the print start signal for each line. The halftone control unit 5 compares the image data of a line obtained from the line memory R1 with the value, and generates recording data "1" for each heat generating element for which the relation [image data] ≧5 (value of density counter 9) is satisfied. Thus serial binary data are supplied to the data input terminal 20 in order to energize the corresponding heat generating elements.

In each subsequent heat generating operation, the count of the density counter 9 is stepwise decreased, then the image data are compared with the count, and the heat generating elements satisfying the condition (image data ≧4), (image data ≧3), . . . are energized. Finally the data readout from the line memory R1 is terminated when the count of the density counter 9 becomes equal to "1".

Subsequently there is started the second pulse applying process. Data of a line are read from the line memory R2, and serial data are supplied to the data input terminal 20 so as to energize the heat generating elements at the positions satisfying the condition [image data]≧0. Then the density counter 9 is switched to an upcounting operation, and comparisons [image data]≧1, [image data]≧2, . . . are conducted as explained above. In this manner there are generated data "1" for the corresponding elements to be energized. With the transfer of data satisfying the condition [image data]≧4, data transfer and the image recording of a line with 5 density levels is completed.

The amount of energy supplied to each heat generating resistor element of the thermal head 10 is controlled according to the data stored in the temperature compensation ROM 8, and a strobe signal STRB of a corresponding duration is supplied to the strobe input terminal 19 of the head driving circuit. The strobe signal is also divided into two pulse applying processes corresponding to two blocks, and eleven strobe pulses in total are supplied corresponding to the number of levels. In the halftone control, the level "0" is handled as a special level, in which the heat generating element is activated until immediately before color generation. Then halftone control is achieved by controlling the heat generation from the level "1" to the maximum level. The pulse duration for the level "0" is selected to be longer than that for the subsequent pulses for other levels, and, in the present embodiment, is selected as a length A equal to two levels and a fraction (less than one level).

The data signals entered into the thermal head 10 through the above-explained operations are stored in the shift register 17, and are supplied to the AND gates $A_1$–$A_n$ simultaneous with the latch signal, whereby selected heat generating resistor elements 15 are activated for the duration of the strobe signal. This operation is repeated for the two pulse applying processes, namely eleven times in total, thereby recording a line in five levels.

The sublimable or fusible ink coated on the ink sheet 12 sublimes or is fused by the thermal energy generated by the heat generating elements 15, and is transferred to the receiving sheet 13, thereby forming an image thereon.

Next there will be explained the method of division of data of a line in the data conversion circuit 3.

FIG. 9 is a timing chart of the pulse application to the heat generating elements in solid black recording in the present embodiment, wherein the abscissa indicates the positions of the heat generating elements $R_1$–$R_k$, while the ordinate indicates time and density levels. In the present embodiment the heat generating elements are divided into two blocks, and four elements at the boundary of the blocks are activated simultaneously with the blocks on both sides. The upper and lower sides of the image data "0" are respectively called first pulse applying process and second pulse applying process (including image data "0"). Also the heat generating elements are numbered from left to right, as $R_1$–$R_k$ in the divided driving unit 101 at left, $R_{k+1}$ –$R_{k+4}$ in four elements in the overlapped driving unit 103 at the center, and $R_{k+5}$–$R_n$ in the divided driving unit 102 at right.

Next there will be explained, with reference to FIG. 9, the case of solid black printing in which all the heat generating elements 14 effect recording with a level "5".

The data of the first pulse applying process are stored in the line memory (W1) 4, while those of the second pulse applying process are retained in the line memory (W2) 4. In the case of solid black printing, the values of the data stored in the line memory (W1) in 40-1 are "5" for all the heat generating elements $R_1$–$R_k$ in the left block 101, and are "4", "3", "2" and "1" respectively for the elements $R_{k+1}$, $R_{k+2}$, $R_{k+3}$ and $R_{k+4}$ in the overlapped driving unit 103. Also the image data are all "0" for the heat generating elements $R_{k+5}$–$R_n$ in the right block 102.

On the other hand, in the line memory W2 in 40-2, there are stored data "0" for all the heat generating elements $R_1$–$R_k$ of the left block 101, "1", 2", "3" and "4" respectively for the elements $R_{k+1}$, $R_{k+2}$, $R_{k+3}$ and $R_{k+4}$ of the overlapped driving unit 103, and "5" for all the elements $R_{k+5}$–$R_n$ of the right block 102.

Then the image data are read from the line memory R1, and the comparisons are made with stepwise decreased count of the density counter 9. The binary data obtained this way are transferred to the thermal head 10. After completing the first pulse applying process in the thermal head 10 in this manner, the second pulse applying process is initiated, in which the image data are read from the line memory R2, repeatedly with stepwise increase of the count of the density counter 9 from "0" to "5".

The above-explained operations allow one to obtain solid black printing, by printing the image data of a line with the heat generating elements divided into plural blocks.

Figure 10:
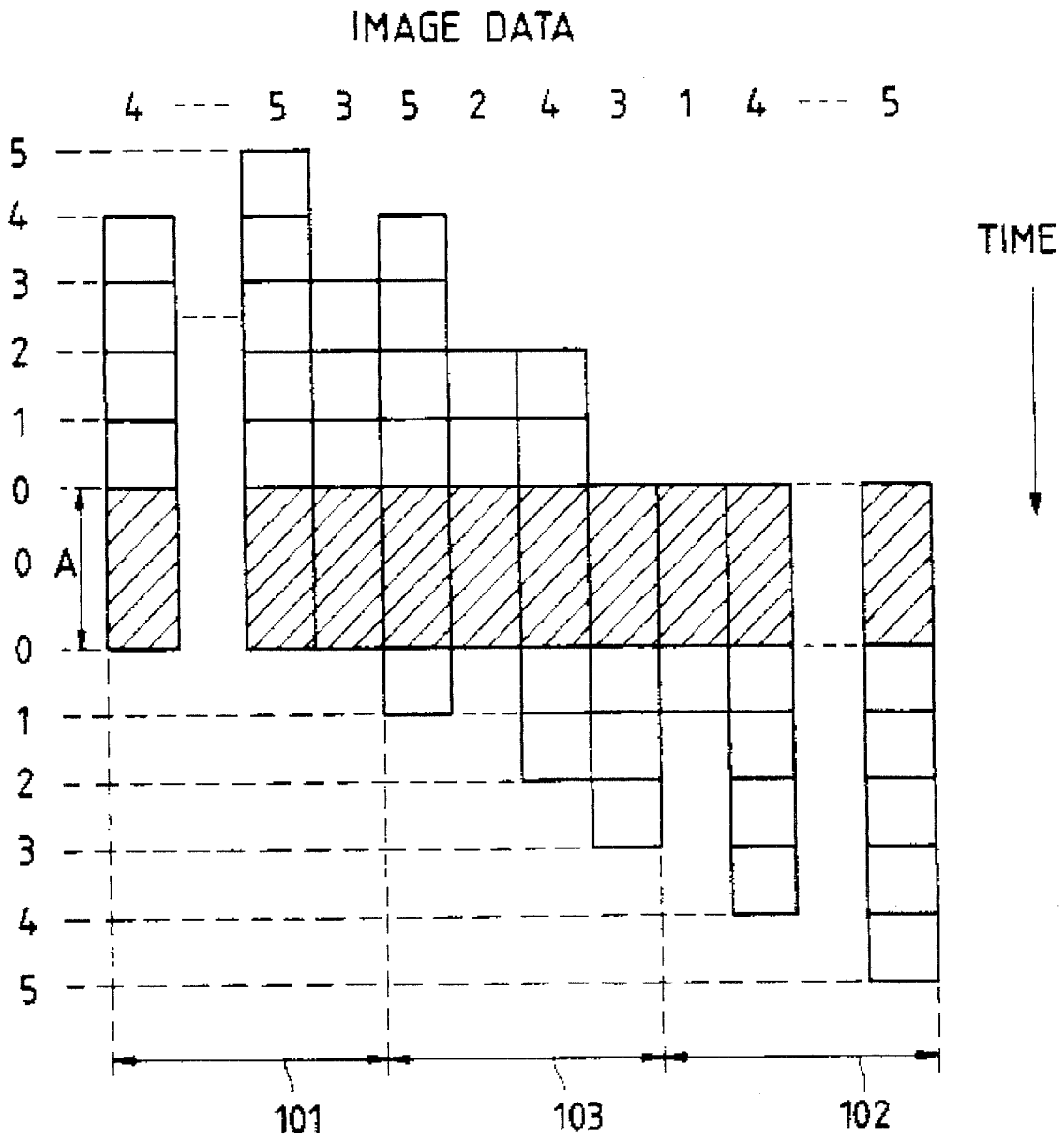
FIG. 10 is a timing chart showing pulse application in the heat generating elements in image data recording in the third embodiment.

FIG. 10 shows the timing of pulse application to the heat generating element for recording ordinary image data instead of solid black data.

In response to the image data which is depicted, the heat generating elements of the left block 101 and the overlapped driving unit 103 are activated in the first pulse applying process. In this process, the data fed to the left block 101 coincide with the actual image data, while the data given to the elements of the overlapped driving unit 103 are "4, 2, 2, 0" in contrast to the actual image data "5, 2, 4, 3". In the second pulse applying process, the elements of the overlapped driving unit 103 are fed data "1, 0, 2, 3".

Figure 11:
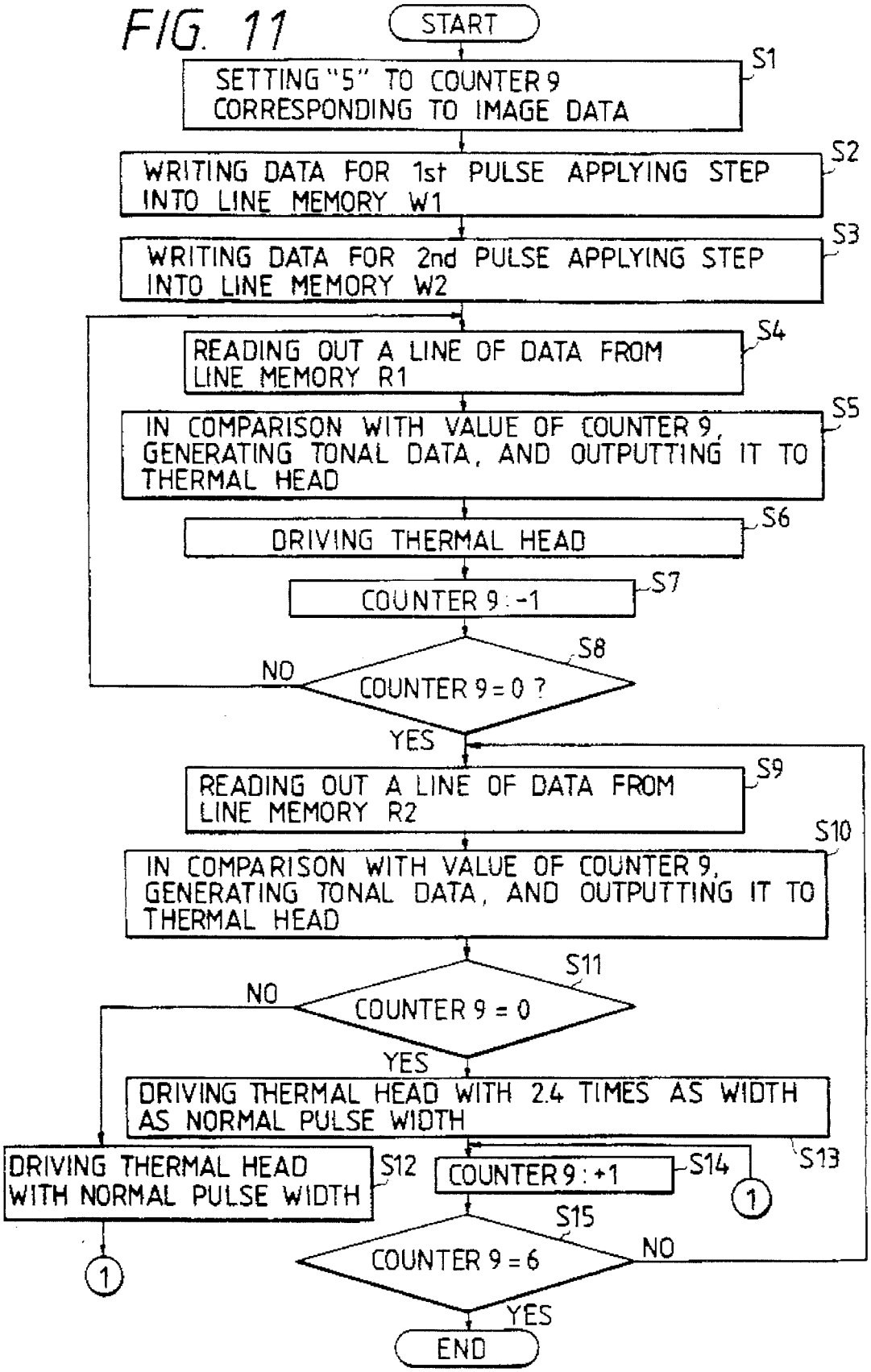
FIG. 11 is a flow chart showing the driving sequence of the thermal head of the third embodiment.

FIG. 11 is a flow chart showing the control sequence of the above-explained pulse application. In the following description a case of solid black printing will be explained.

At first a step S1 sets a value "5" in the density counter 9, corresponding to the value of the image data. Then step S2 stores the image data for the first pulse applying process in the line memory W1. More specifically, there are stored data "5" for all the heat generating elements of the left block 101; "4, 3, 2, 1" for the elements of the overlapped driving unit 103; and "0" for all the elements in the right block 102. Then step S3 stores the image data for the second pulse applying process in the line memory W2. More specifically there are stored "0" for all the elements of the left block 101; "1, 2, 3, 4" for the elements of the overlapped driving unit 103; and "5" for all the elements of the right block 102.

Then step S4 reads the image data of a line from the line memory R1, and step S5 effects comparison thereof with the value of the density counter 9 and generates serial recording data, in which the signal is "1" for the heat generating element satisfying the condition [image data]≧[value of density counter 9], for supply to the thermal head 11. Then step S6 sends the strobe signal STRB to the thermal head 11, thereby activating the heat generating elements. Then step S7 decreases the count of the density counter 9 by one, and the steps S4 to S8 are repeated until step S8 identifies that the count of the density counter 9 is equal to "0".

When the step S8 identifies that the count of the density counter 9 is "0", step S9 reads the image data of a line from the line memory R2, and step S10 effects comparison with the count of the density counter 9 in a similar manner as in step S5, thereby determining the data to be supplied to the thermal head 11, and sends data serially to the thermal head 11.

Step S11 discriminates whether the count of the density counter 9 is "0", and, if affirmative it is, the sequence proceeds to step S13 for activating the thermal head 11 with a pulse duration that is about 2.4 times that of the ordinary value, thereby effecting the recording of the level "0". On the other hand, if the count of the density counter 9 is not "0", the sequence proceeds to step S12 for activating the thermal head 11 with the ordinary pulse duration. Then a step S14 increases the count of the density counter 9 by one, and the steps S9 to S14 are repeatedly executed until step S15 determines that the count is "6". The timing of pulse application to the thermal head 11 in the above-explained printing is shown in FIGS. 9 and 10.

Figure 12:
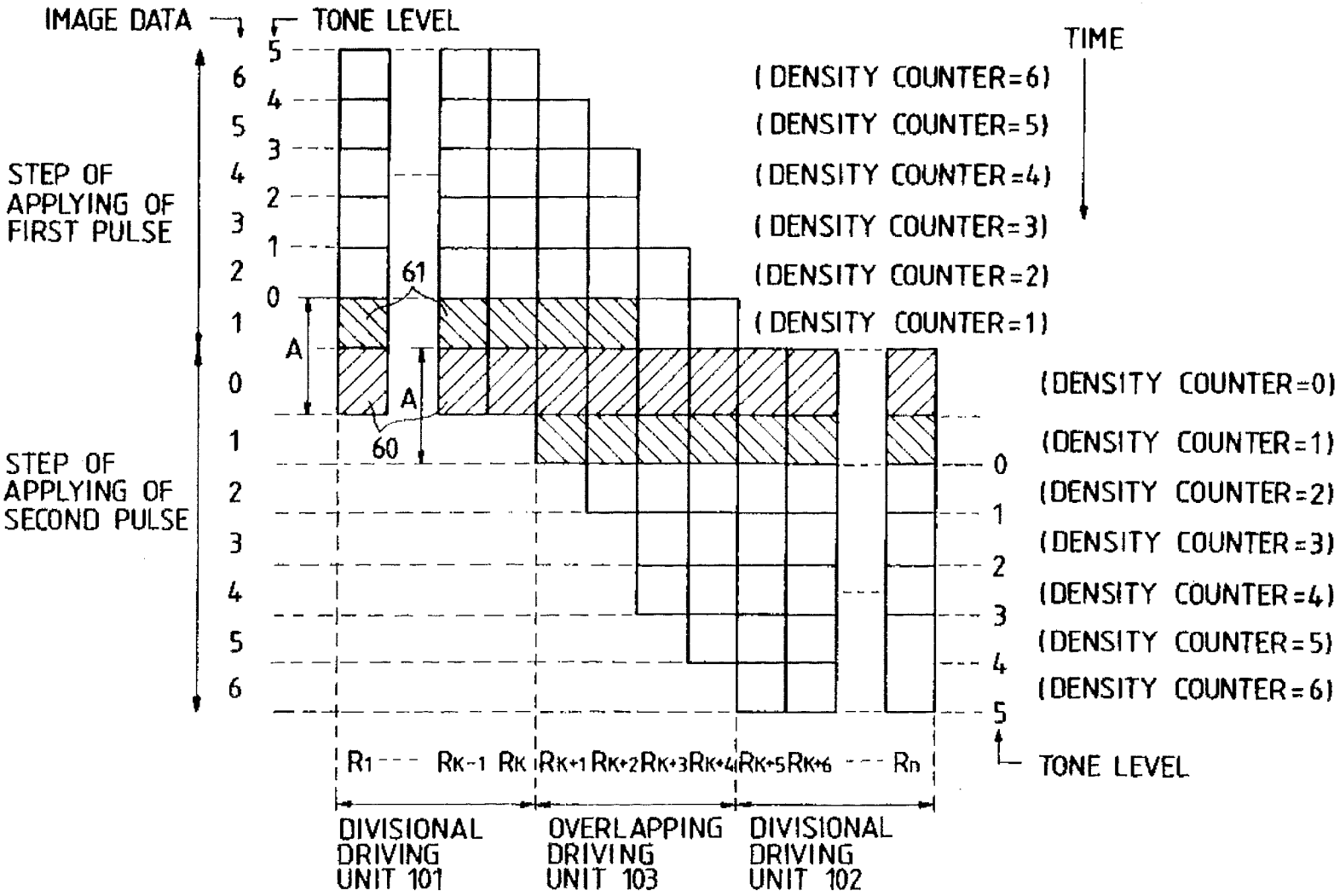
FIG. 12 is a timing chart showing pulse application in solid black recording in the fourth embodiment.

Next there will be discussed another embodiment of the invention, with reference to FIG. 12. In contrast to the case of FIG. 9 in which all the heat generating elements of the thermal head 11 are simultaneously activated at the level "0", in the embodiment shown in FIG. 12, the simultaneous activation time of all the elements at the level "0" is shortened to reduce the demands on the power supply source. Components having same numbers as those shown in FIG. 9 will not be explained as they are same components with the same functions or effects.

The pulse duration A for the level "0" corresponds to a duration of two data and a fractional part, of which a duration 60 corresponding to one data and the fractional part is made to represent "0" of the density counter 9, while the remaining duration 61 corresponding to one data is made to represent "1" in counter 9. Consequently, in comparison with the case shown in FIG. 9, the maximum value of the density counter 9 is increased to "6", and the pulse duration 60 for the image data "0" is shortened, by one data, than the duration A. In this embodiment, since the simultaneous activation time of two blocks is made shorter than the duration A, the pulse duration at the peak activation is made shorter, and the capacitor etc. in the power source can be made smaller and less expensive.

Such an embodiment can be realized, in the flow chart shown in FIG. 11, by setting "6" in the density counter 9 in step S1, and by activating the thermal head 11 in step S13 for a duration of about 2.4 times that in the ordinary halftone recording.

It is also possible to obtain 7 levels by taking the level "0" as the fractional part and adding data of two levels to the data shown in FIG. 9, disregarding the data transfer time.

As explained above, in this third embodiment, a group of plural heat generating elements positioned at the boundary of adjacent blocks is simultaneously activated with each of this blocks, and an image of high quality without division lines can be obtained using a power source of limited capacity by controlling the pulse application in such a manner that the time difference between the pulse application to the group of elements and to the adjacent block of elements does not exceed the maximum duration of the pulse applied to the elements.

In the following there will be explained a fourth embodiment of the present invention.

Figure 13:
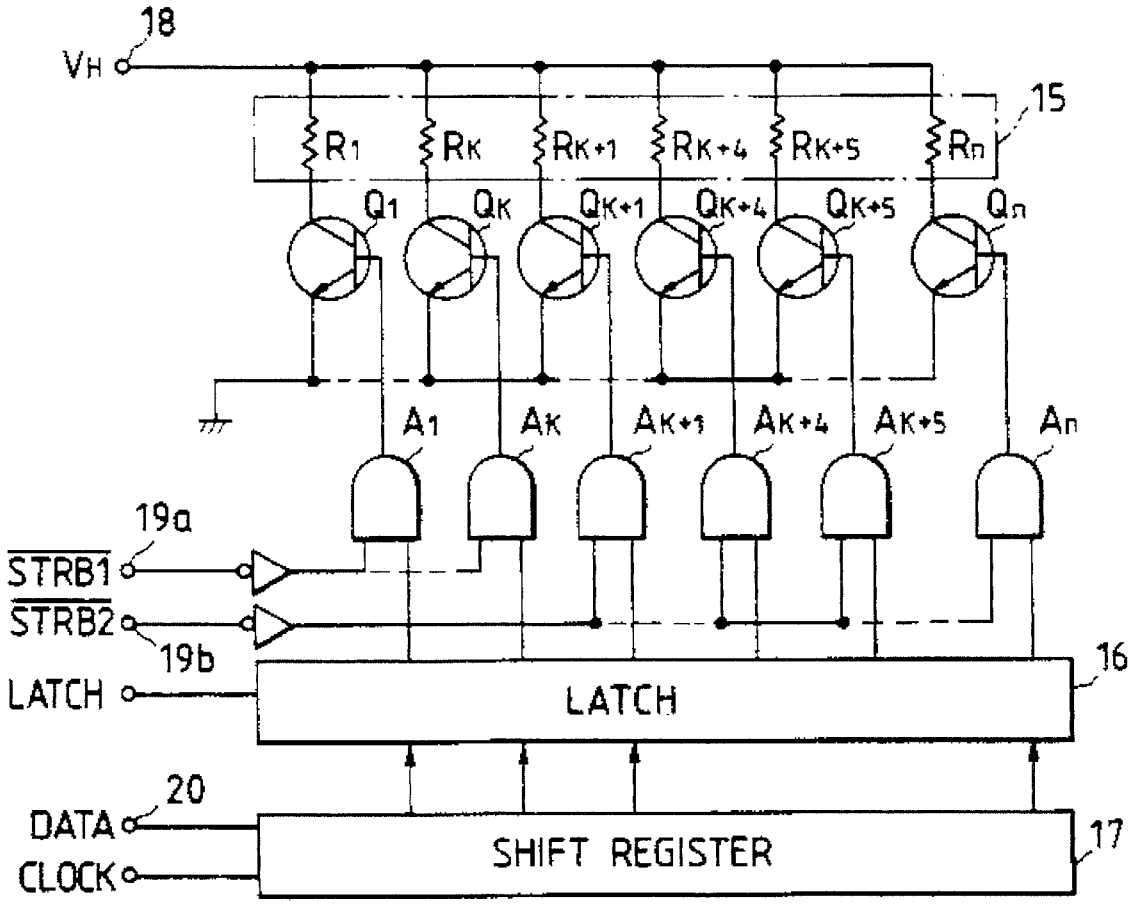
FIG. 13 is a block diagram schematically showing the structure of a thermal head employed in embodiments shown in FIGS. 14, 15, 16 and 17.

FIG. 13 is a block diagram of a thermal head to be employed in the embodiment.

The thermal head is different from that shown in FIG. 2 because the strobe signal is divided into two signals, namely a strobe signal STRB1 entered from an input terminal 19*a* for energizing the divisional driving unit 101, and another strobe signal STRB2 entered from an input terminal 19*b* for energizing the overlapped driving unit 103 and the divisional driving unit 102.

The operation of the present embodiment will be explained in the following, with reference to the timing charts of pulse application shown in FIGS. 14 and 15.

The input terminal 1 receives the B, G and R signals in succession, from a color image memory (not shown), corresponding to the order of printing of Y, M and C. These signals are converted by the color conversion circuit 2 into Y, M and C signals.

The color conversion circuit 2 transfers the image data, in units of each print line, to the data conversion circuit 3. The image data of a line are divided according to predetermined proportions, for two pulse applying processes to be explained later, as the data for each heat generating element designated by the address counter 7, and the thus divided data are respectively stored in two line memories (W1, W2) 40-1, 40-2. Then the data of a line are read from the line memory (R1) 40-1 by a number of times corresponding to the number of levels (7 times in the present embodiment), and transferred to the halftone control unit 5. Then similar operations are conducted (readings of 7 times in the present embodiment) with respect to the line memory (R2) 40-2. Simultaneous with the print start signal for each line, a value "7" corresponding to the number of levels is set in the density counter 9, and the halftone control unit 5 compares the image data of a line obtained from the line memory R1 with said value, and generates serial data for energizing the elements only in positions where the relationship [image data]≧7 holds. The serial data are transferred to the data input terminal 20 of the thermal head.

Thereafter similar operations are repeated with stepwise decreases of the count of the density counter 9 with comparisons [image data]≧6, [image data]≧5 . . . The data readout from the line memory (R1) 40-1 is terminated when the value of the density counter 9 reaches "1".

Subsequently the data of a line are read from the line memory (R2) 40-2 and serial data for energizing the elements only at positions where the relationship [image data] ≧0 holds, are transferred to the data input terminal 20. The density counter 9 is switched to an upcounting operation, and, after comparisons [image data]≧1, [image data]≧2, . . . , the data transfer of a line with 5 levels is completed with the data transfer for comparison [image data]≧6.

The amount of energy supplied to each heat generating element resistor element 15 is controlled according to the data stored in the temperature compensation ROM 8, and corresponding strobe signals are supplied to the strobe input terminals 19*a*, 19*b* of the head driving circuit. This strobe signals are also divided into two pulse applying processes in a manner similar to the data transfer, and fourteen strobe pulses in total are supplied corresponding to the number of levels.

The data signals applied to the thermal head 10 through the above-explained operations are stored in the shift register 17, and, simultaneous with latching, are supplied to the AND gates $A_1$–$A_n$, whereby logic multiplications with the strobe signal are conducted and the heat generating elements 15 corresponding to the recording data are energized for the duration of the strobe signal. This operation is repeated for the two pulse applying processes, for a total of fourteen times, thereby recording an image of a line with 5 levels.

In the following there will be explained the method of data division in the data conversion circuit 3.

FIG. 14 is a timing chart of the pulse application to the heat generating elements in the case of solid black printing in the present embodiment, wherein the abscissa indicates the positions of the heat generating elements, while the ordinate indicates time and density levels. In the present embodiment the heat generating elements are divided into two blocks, and four elements at the boundary of the blocks are activated simultaneously with both blocks. The upper and lower sides of the image data "0" are called the first pulse applying process and the second pulse applying process respectively (including image data "0"). Also, as in the foregoing embodiments, the heat generating elements are numbered from left to right, as $R_1$–$R_k$ in the divided driving unit 101 at left, $R_{k+1}$–$R_{k+4}$ in four elements in the overlapped driving unit 103 in the center, and $R_{k+5}$–$R_n$ in the divided driving unit 102 at right. In the present embodiment, in the case of halftone control, the pulse duration F for the level "0" is longer than that for other levels, and, in the present embodiment, is equal to the sum of a duration corresponding to two levels and a fractional part, approximately less than the duration for a level.

At first there will be explained the case of solid black printing, in which all the heat generating elements record the level "5".

Data of the first pulse applying process and those of the second pulse applying process are respectively stored in the line memories (W1) 40-1 and (W2) 40-2. More specifically, in the case of solid black printing, the data stored in the line memory (W1) 40-1 are "7" for all the heat generating elements $R_1$–$R_k$ generating elements $R_{k+1}$, $R_{k+2}$, $R_{k+3}$, $R_{k+4}$ of the in the left block 101, "5, 4, 3, 2" for the heat overlapped driving unit 103, and "0" for all the elements $R_{k+5}$–$R_n$ in the right block 102.

In the line memory (W2) 40-2, there are stored data "0" for all the heat generating elements $R_1$–$R_k$, "1, 2, 3, 4" for the elements $R_{k+1}$–$R_{k+4}$ in the overlapped driving unit 103, and "6" for the elements $R_{k+5}$–$R_n$.

Then the image data are repeatedly read from the line memory (R1) 40-1, starting from the value "7" in the density counter 9 as explained before. After the completion of the first pulse applying process in this manner, the second pulse applying process is initiated by reading the image data from the line memory (R2) 40-2, with the value of the density counter 9 from "0" to "6".

In the following there will be explained the strobe signal. The overlapped driving unit 103 and the divisional driving unit 102 are simultaneously controlled by the strobe input terminal **19*b*. However, for input data "0", the strobe signal is equal to one level plus a fractional part, in order to handle the fractional portion. The divisional driving unit 101 is controlled by the strobe input terminal 19*a*, independently from the overlapped driving unit 103 and the divisional driving unit 102**, and the application of the above-mentioned fractional pulse is conducted at the input data "0" in the second pulse applying process.

The pulse application shown in FIG. 14 can be achieved, as in the flow chart shown in FIG. 11, by setting a value "7" in the density counter 9 in the step S1, and releasing, in the step S13, the strobe signal STRB2 for a period corresponding to (one level+ fractional part) and the strobe signal STRB1 for a period corresponding to the fractional part. In this manner the energy supplied to the thermal head at the level "0" is reduced to approximately half of the energy required for energizing all the heat generating elements of the thermal head, so that the capacity of the power source required to drive the thermal head can be reduced.

Figure 15:
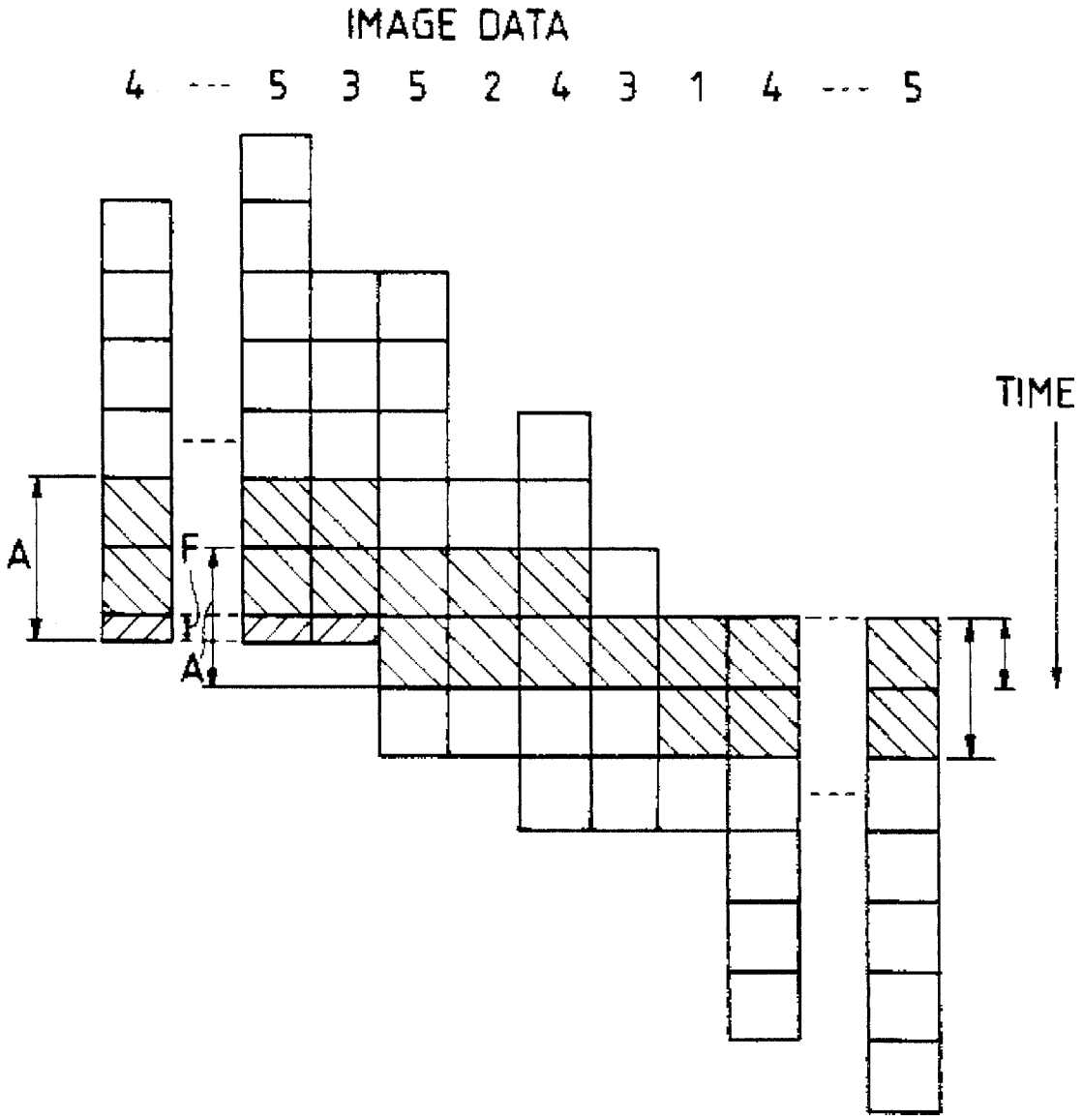

FIG. 15 is a timing chart of the pulse application to the heat generating elements for ordinary image data.

As explained in the foregoing, in the present embodiment, a group of plural heat generating elements, positioned at the boundary of blocks of the heat generating elements, is energized simultaneously with one of the adjacent blocks, and time differences are given to the pulses supplied to the elements of said group, in such a manner that the time difference between the pulse applied to the group of elements and the pulse applied to the elements of the adjacent block does not exceed the maximum duration of the pulses applied to the elements, whereby an image of high quality without division lines can be obtained using a power source of limited capacity.

In the following there will be explained a fifth embodiment of the present invention.

Figure 16:
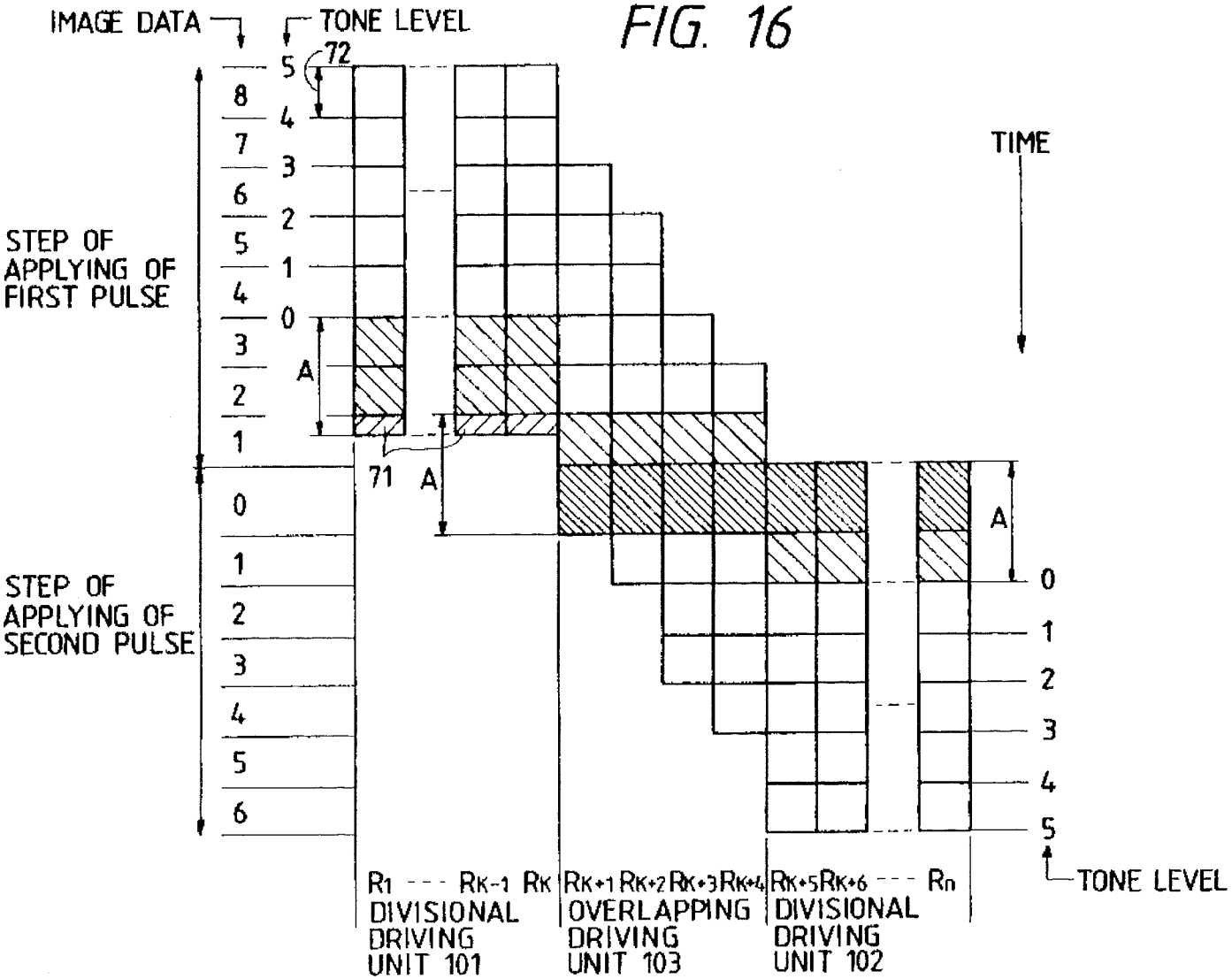
FIGS. 16 and 17 are timing charts showing pulse application in a fifth embodiment.
Figure 17:
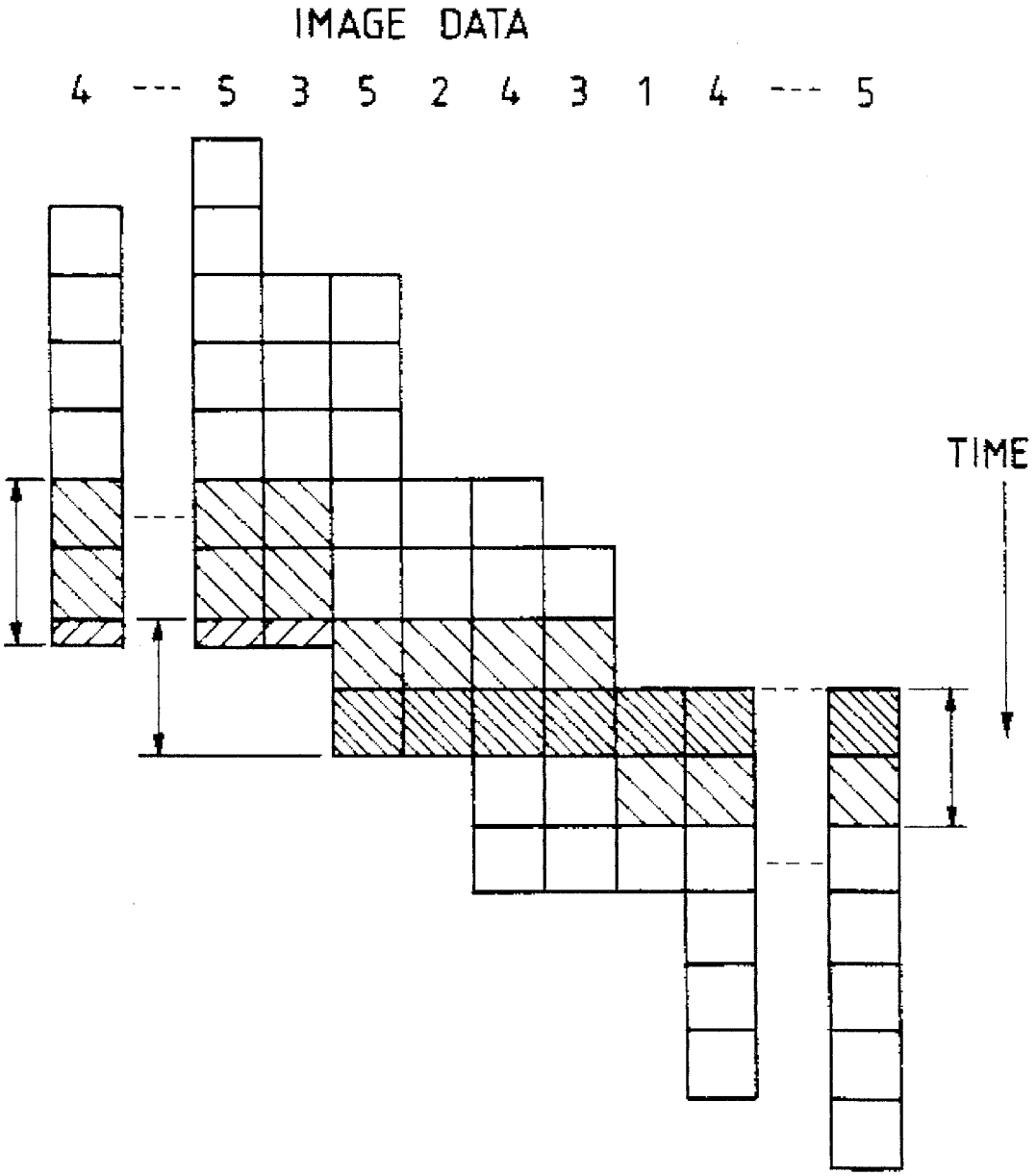

FIGS. 16 and 17 are timing charts of the pulse application in the present embodiment, respectively corresponding to solid black printing and printing of ordinary image data.

As in the foregoing embodiments, the input terminal 1 receives the B, G and R signals in succession, from an unrepresented color image memory, corresponding to the order of printing Y, M and C. These signals are stored in two line memories W1, W2. The number of levels of the image data is "8" in the present embodiment. Consequently the data of a line are repeatedly read 8 times corresponding to the number of levels, from the line memory (R1) 40-1 and are transferred to the halftone control unit 5. Subsequently similar operations (7 times in the present embodiment) are conducted with respect to the line memory (R2) 40-2.

Then a value "8" corresponding to the number of levels is set in the density counter 9 simultaneously with the print start signal for each line, and the halftone control unit 5 compares the image data of a line obtained from the line memory R1 with this value and generates serial data for energizing the elements only in positions where relationship [image data]≧8 holds true. The serial data are transferred to the data input terminal 20. Thereafter similar operations are repeated with stepwise decreases in the count of the density counter 9, and the data readout from the line memory (R1) 40-1 is terminated when the count of the density counter 9 reaches "1". Subsequently the data of a line are read from the line memory (R2) 40-2 and serial data for energizing the elements only at positions where the relationship [image data]≧holds, are transferred to the data input terminal 20. The density counter 9 is switched to an upcounting operation, and, after comparisons [image data]≧1, [image data]≧2, . . . , the data transfer of a line with 5 levels is completed with the data transfer for comparison [image data]≧6.

The amount of energy supplied to each heat generating element resistor element 15 is controlled according to the data stored in the temperature compensation ROM 8, and corresponding strobe signals are supplied to the strobe input terminals 19*a*, 19*b*. The strobe signals are also divided into two pulse applying processes in a manner similar to data transfer, and fifteen strobe pulses in total are supplied corresponding to the number of levels.

FIG. 16 is a timing chart of the pulse application to the heat generating elements in the case of solid black printing in the present embodiment, wherein the abscissa indicates the positions of the heat generating elements, while the ordinate indicates time and density levels.

In the present embodiment the heat generating elements are divided into two blocks, and four elements at the boundary of the blocks can be activated simultaneously with each of the blocks. The upper and lower sides of the image data "0" are respectively called the first pulse applying process and the second pulse applying process (including image data In the case of halftone control, the level "0" is processed as a particular level for energizing the elements to an extent immediately before color generation, and the halftone control is achieved from the level "1" to the maximum level by regulating the heat generation. The pulse duration A in the level "0" is longer than that for subsequent levels, and, in the present embodiment, is equal to two levels plus a fractional portion, which is approximately less than a level.

In the printing shown in FIG. 16, data of the first pulse applying process and those of the second pulse applying process are respectively stored in the line memories (W1) 40-1 and (W2) 40-2. More specifically, in case of solid black printing, the data stored in the line memory (W1) 40-1 are "8" for all the heat generating elements $R_1$–$R_k$, "6, 5, 3, 2" respectively for the heat generating elements $R_{k+1}$, $R_{k+2}$, $R_{k+3}$, $R_{k+4}$ of the overlapped driving unit 103, and "0" for all the heat generating elements $R_{k+5}$–$R_n$ in the divisional driving unit 102. In the line memory (W2) 40-2 there are stored data "6", with the uppermost bit "1" in 5-bit data, for the elements $R_1$–$R_k$, "0, 1, 3, 4" respectively for the elements $R_{k+1}$, $R_{k+2}$, $R_{k+3}$, $R_{k+4}$, and "6" for the elements $R_{k+5}$–$R_n$.

Then the image data are repeatedly read from the line memory (R1) 40-1, starting from the value "8" in the density counter 9 as explained before. After completing the first pulse applying process in this manner, the second pulse applying process is initiated. In this process the uppermost bit is treated as a particular bit, and, if it is "1", all the data signals to the thermal head are shifted to the low level, thus making a distinction from the case of ordinary image data.

Through the above-explained operations, the divided data for solid black printing are transferred to the thermal head.

In the following there will be explained the strobe signal. The divisional driving unit 101 is controlled by the strobe terminal 19*a*, while the overlapped driving unit 103 and the divisional driving unit 102 are simultaneously controlled by the strobe terminal 19*b*. However, the pulse duration for the image data "0" is equal to [one level+fractional portion] in order to cope with the fractional part. The divisional driving unit 101 is controlled by the strobe terminal 19*a*, independently from the overlapped driving unit 103 and the divisional driving unit 102. Also in response to the input data "1" in the second pulse applying process, the pulse corresponding to the fractional part in the level "0" is applied, whereby the pulse duration for the level "0" is made equal to [two levels±fractional part].

Figures 18, 18A:
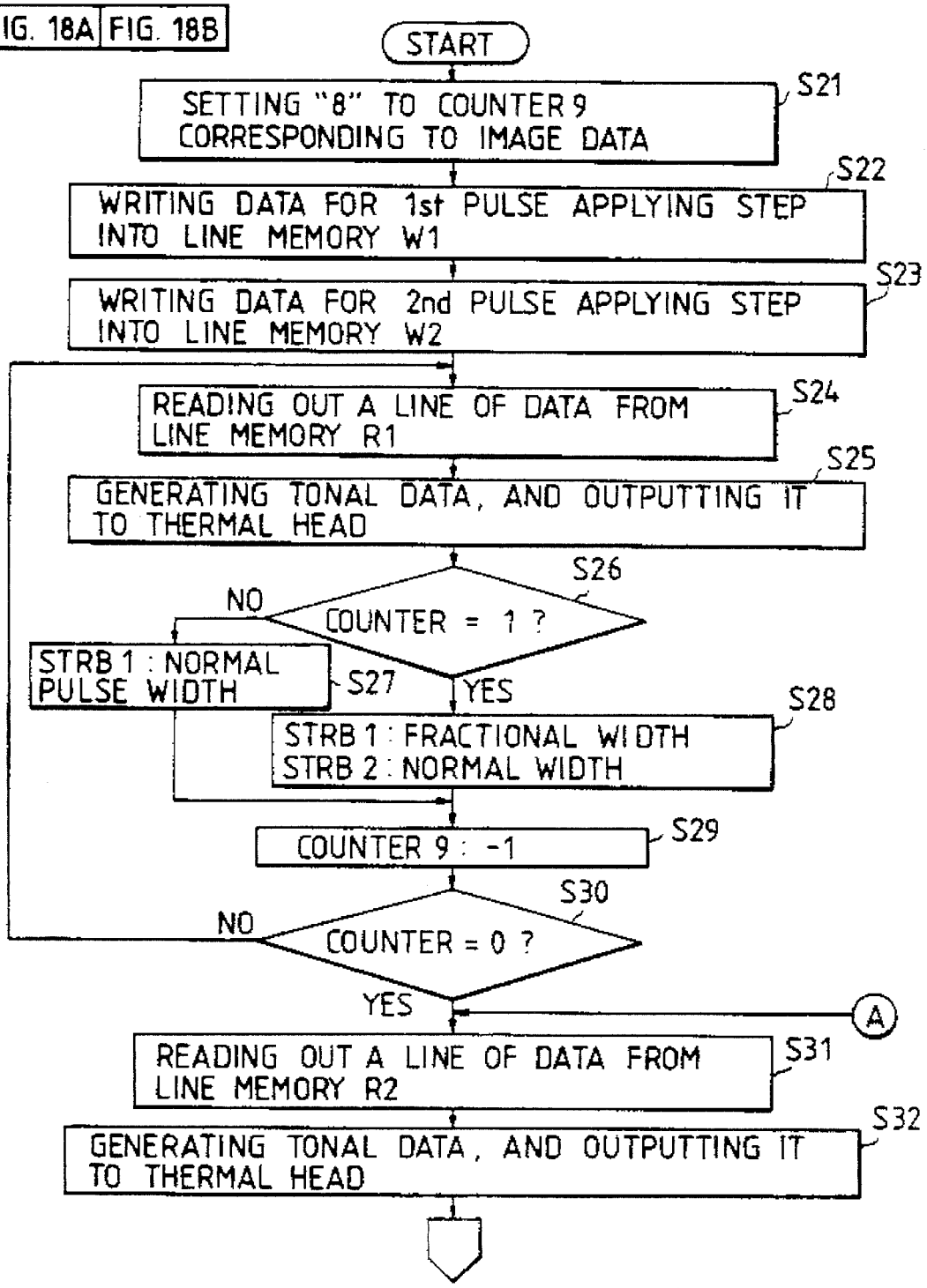
FIGS. 18, 18A and 18B are a flow chart showing the sequence of pulse application to the thermal head and of recording in the fifth embodiment.
Figure 18B:
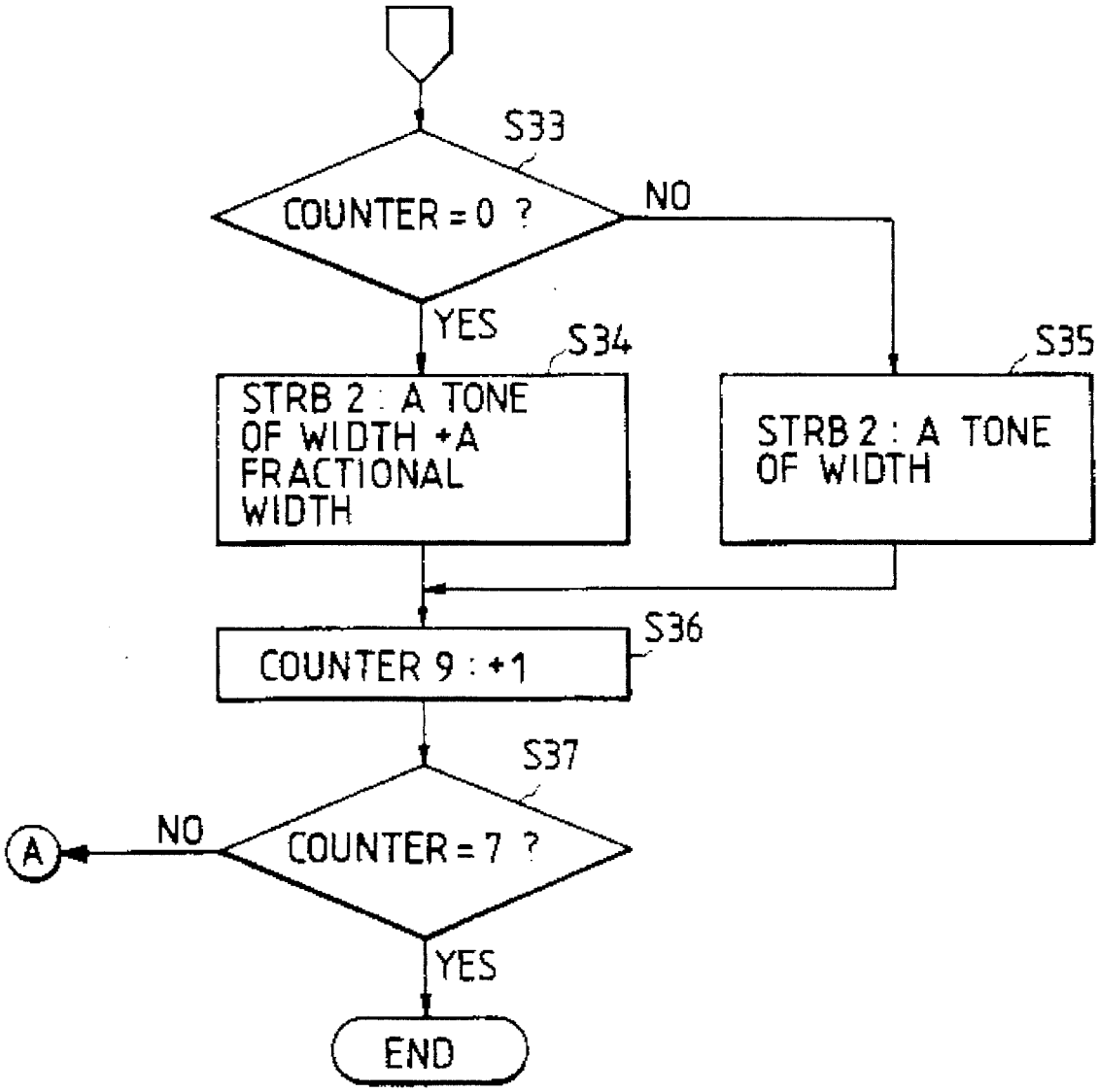

FIG. 18 is a flow chart of the pulse application explained above. Because the maximum value of image data is "8", step S21 sets a value "8" in the density counter 9. Steps S22–S25, similar to the steps S2–S5 in FIG. 11, prepare recording data of a line based on the data from the line memory R1 and send recording data to the thermal head. Then step S26 discriminates whether the count of the density counter 9 is "1", and, if not, step S27 energizes the thermal head with the normal pulse duration.

If the count of the density counter 9 is "1", step S28 energizes the thermal head with the strobe signal STRB1 of a duration equal to a fractional part and the strobe signal STRB2 of the normal pulse duration. In this manner the pulse application 71 shown in FIG. 16 can be realized.

In the following there will be explained the differences from the flow chart shown in FIG. 11. If step S33 identifies that the value of the density counter 9 is "1", step S34 selects the duration of the strobe signal STRB2 equal to (one level+fraction). If the value is not "0", step S35 selects the duration of the strobe signal STRB2 to be equal to a level 72 shown in FIG. 16.

As explained in the foregoing, the present embodiment reduces the number of heat generating elements that are simultaneously energized at the level "0", and reduces the energizing period.

FIG. 17 similarly shows the timing of pulse application to the heat generating elements, in the case of ordinary image data.

As explained in the foregoing, in the present embodiment, a group of heat generating elements, positioned at the boundary of adjacent blocks which are not simultaneously energized, is energized simultaneously with each of two blocks adjacent to the group. There is also provided a time period in which just the group of elements at the boundary can be energized. Thus, an image of high quality without division lines can be obtained using a power source of limited capacity, by giving time differences to the pulses applied to the heat generating elements of the group and effecting control in such a manner that the time difference between the pulses to said elements and the pulse applied to the elements of either block does not exceed the maximum duration of the pulse applied to each element.

In the following there will be explained a sixth embodiment of the present invention, in which plural heat generating elements of the thermal head are divided into blocks A, B and an overlapped driving unit, and the pulse duration of the strobe signal applied to the overlapped driving unit is made to be shorter than that applied to the blocks A and B.

Figure 19:
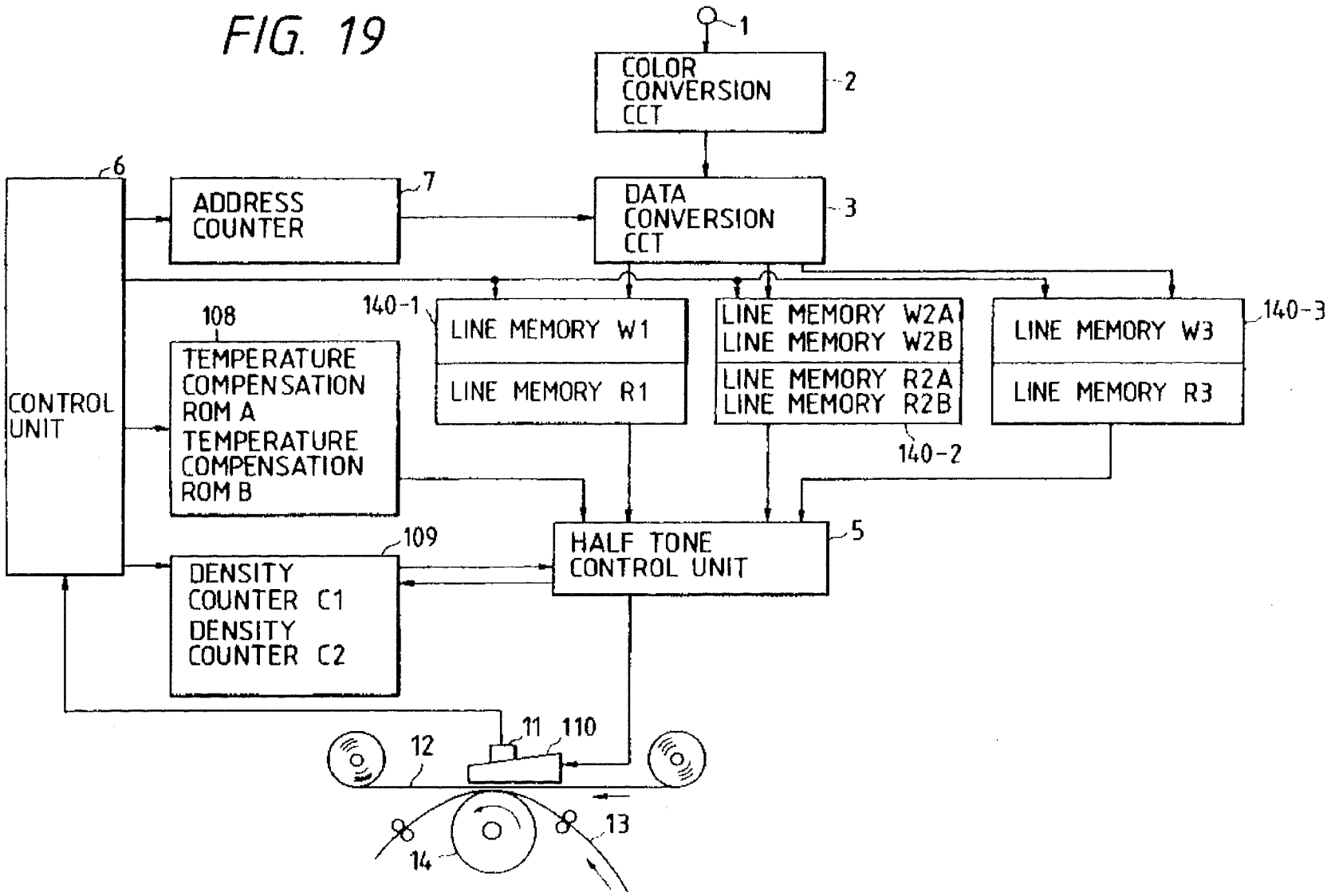
FIG. 19 is a block diagram of a thermal printer constituting a sixth embodiment of the present invention.

FIG. 19 is a block diagram of a thermal printer constituting the present embodiment, wherein components also shown as those in FIG. 1 are represented with the same numbers. There is also shown a temperature compensation ROM 108 storing data for determining the density level according to the color of the ink sheet and the temperature around the thermal head; a density counter 109 for counting the number of strobe signals; a thermal head 110; and line memories 140-1, 140-2, 140-3.

Figure 20:
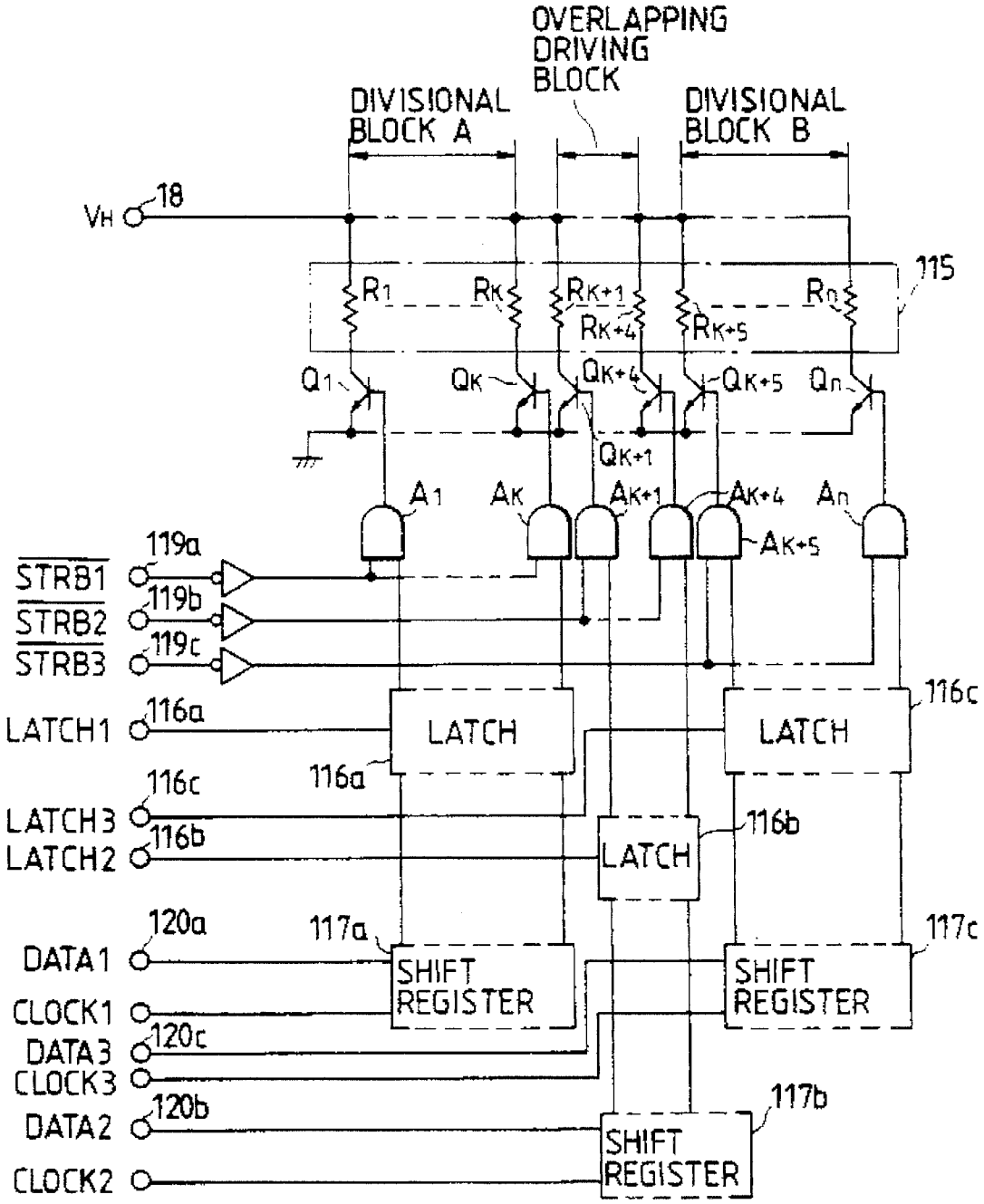
FIG. 20 is a circuit diagram of a thermal head driver provided on the thermal head shown in FIG. 19.

FIG. 20 shows the structure of a thermal head driving unit provided in the thermal head 110 shown in FIG. 19.

In FIG. 20 there are shown heat generating resistor elements 115; latches 116*a*, 116*b*, 116*c*; shift registers 117*a*, 117*b*, 117*c*; a common electrode 118; strobe signal input terminals 119*a*, 119*b*, 119*c*; and data signal input terminals 120*a*, 120*b*, 120*c*.

Figures 1, 26:
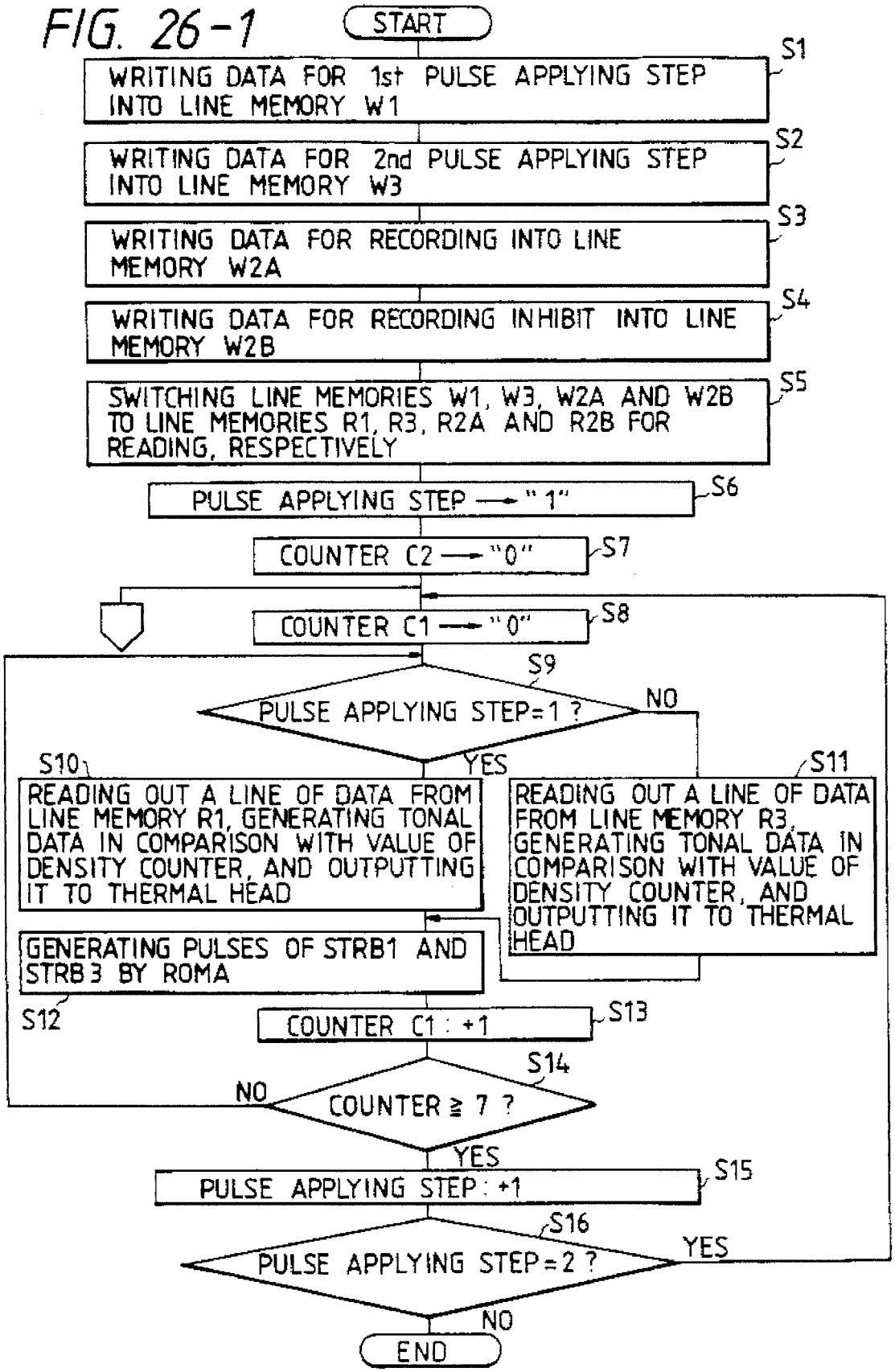
Figures 2, 26:
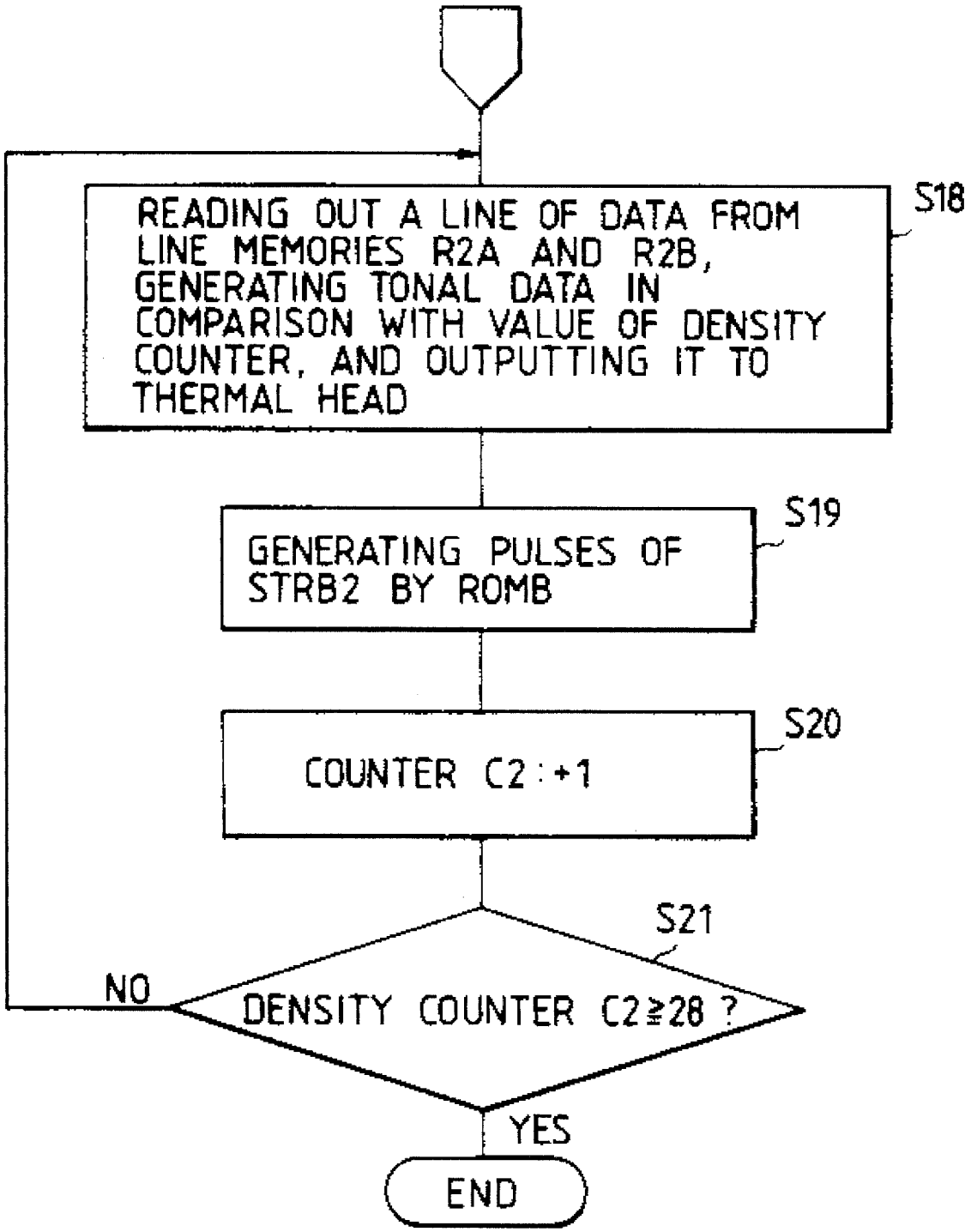

FIG. 26 is a flow chart showing the control sequence.

At first step S1 stores the data for the first pulse applying process in the line memory W1, and step S2 stores the data for the second pulse applying process in the line memory W2. Then step S3 stores recording data in the line memory W2A, and step S4 stores record inhibiting data in the line memory W2B.

After the data storage into the line memories, the line memories W1, W3, W2A, W2B are switched to line memories R1, R3, R2A, R2B for reading. Then step S6 sets the pulse applying process "1", step S7 steps "0" in the density counter C2, and step S8 sets "0" in the density counter C1.

Then step S9 discriminates whether the pulse applying process is "1", and, if "1", the sequence proceeds to step S10.

Step S10 reads data of a line from the line memory R1, prepares recording data through comparison of the count of the density counter C1, and sends the data to the thermal head. Then step S12 prepares the strobe pulses STRB1, STRB3 according to the temperature compensation ROM, and step S13 increases the count of the density counter C1 by one. Step S14 discriminates whether the count of the density counter C1 is "7", and, if not, steps S9 to S13 are repeated until the count reaches "7".

If step S14 identifies that said count is "7", step S15 increases the count of the pulse applying process by one, and step S16 discriminates that the count is "2". If "2", the sequence returns to the step S8 to set "0" in the density counter C1.

Then step S9 discriminates whether the count of said pulse applying process is "1". As said count is "2" in this state, the sequence proceeds to step S11 which reads the data of a line from the line memory R3, prepares the recording data through comparison with the count of the density counter, and sends the data to the thermal head. Then step S12 prepares the strobe pulses STRB1, STRB3 according to the temperature compensation ROM, and step S13 increases the count of the density counter C1 by one. Then step S14 discriminates whether the count is "7", and, if not, the steps S9, S11 and S12 to S14 are repeated until the count reaches "7".

When the count reaches "7", step S15 increases the count of the pulse applying process by one, and step S16 discriminates whether the count is "2". Since the count is "3" in this state, the sequence is terminated. The printing of the divided blocks A, B is achieved by the procedure explained above.

Next, the recording of the overlapped driving unit will be explained. Step S18 reads the data of a line from the line memories R2A, R2B, prepares recording data through the comparison with the count of the density counter, and sends the data to the thermal head. Step S19 prepares the strobe pulse STRB2 according to the temperature compensation ROM B. Then step S20 increases the count of the density counter C2 by one, and step S21 discriminates whether the count is "28". If not, steps S18 to S21 are repeated until the count reaches "28", and, the sequence is terminated when the count reaches "28". The recording of the block corresponding to the overlapped driving unit is achieved by the procedure explained above.

In the following there will be given a detailed description of the operation of the present embodiment.

The input terminal 1 receives the B, G and R signals from an unrepresented color image memory, according to the order of printing of Y, M and C. The entered signals are converted into Y, M and C signals in the color conversion circuit 2.

Color conversion circuit 2 transfers the image data of the divided block A, overlapped drive block and divided block B in the unit of each recording line, and the image data of the divided blocks A, B are stored in the line memories (W1, W3) 140-1, 140-2. In addition the image data of the overlapped drive block are supplied from the color conversion circuit 2 to the data conversion circuit 3 for data conversion, and are stored in the line memories W2A, W2B. The data of a line in the overlapped drive block are divided, for each element designated by the address counter 7, into recording data and recording inhibition data in predetermined proportions, as will be explained in greater detail below.

Then the data of a line are read from the line memory (R1) 140-1 by a number of times corresponding to the number of levels (7 times in the present embodiment) and transferred to the halftone control unit 5 for effecting the recording of the divisional driving unit A. Upon completion of recording, the data of a line are read from the line memory (R3) 140-3 by a number of times corresponding to the number of levels (7 times in the present embodiment) and transferred to the halftone control unit 5 for effecting the recording of the divisional driving unit B.

In the following there will be explained in greater detail the printing of line with respect to the divisional driving units A, B. Simultaneous with the print start signal for each line, a value "0" is set in the density counter (C1) 9, and the halftone control unit 5 compares the data of a line from the line memory (R1) 140-1 with the value, and provides the data input terminal 120*a* with serial data which energize only the elements which are in positions satisfying the condition [input data]≧0.

Subsequently the value of the density counter (C1) 9 is stepwise increased to effect comparisons [input data]≧1, [input data]≧2 . . .

The data readout from the line memory (R1) 140-1 is terminated upon completion of the transfer of serial data to the data input terminal 120*a* when the value of the density counter (C1) 109 reaches "6". Then the density counter (C1) 109 is set at a value "0", and the halftone control unit 5 compares the data of a line from the aforementioned line memory (R3) 140-3 with the value, and provides the data input terminal 120*c* with serial data for energizing only the elements which are in positions satisfying a condition input data≧0.

Subsequently the value of the density counter (C1) 109 is stepwise increased to effect comparisons [input data]≧1, [input data]≧2 . . . in a similar manner, and the data transfer of a line with 7 levels is terminated when the data satisfying a condition [input data]≧6 are transferred.

The writing mode and the reading mode of the line memories are switched at a predetermined timing at the start of a line printing operation.

The amount of energy supplied to the heat generating resistor element 115 is controlled according to the data of the temperature compensation ROM 108, and corresponding strobe signals are supplied to the strobe input terminals 119*a*, 119*c* of the head driving circuit. The strobe signals are also divided, like the date transfer, into two pulse applying processes, and the pulse application to the divided block B is conducted after the completion of pulse application to the divided block A. In this embodiment, the temperature of the heat generating element is raised close to the sublimation temperature of the ink by the applied pulse corresponding to the level "0", and the density level control is conducted by the number of pulses applied thereafter.

The data signals supplied to the head driving circuit through the above-explained operations are stored in the shift register 117*a* and latched therein, and the data of a level, over a line, are supplied to the AND gates $A_1$–$A_k$ for logical multiplication with the strobe signal 119*a*, whereby the selected heat generating elements 115 are energized for the pulse duration of the strobe signal 119*a*. The recording of the divided block A in the present embodiment is completed by repeating the above-explained operations 7 times. Immediately thereafter the recording of the divided block B is conducted but this reed not be explained further as it is similar to that of the block A.

The sublimable or fusible ink coated on the ink sheet 12 sublimes or is fused by the heat of the heat generating element 115 and is transferred onto the receiving sheet 13, forming an image thereon.

In the following there will be explained in detail the recording operation of the overlapped drive block.

The overlapped drive block is controlled independently from the divided blocks A, B. Data of a line are read from the line memories (R2A, R2B) 104 by a number of times corresponding to the number of levels (28 times in the present embodiment), and are transferred to the halftone control unit 5 for effecting the recording operation. A line printing operation is conducted in the following manner. At first, simultaneous with the print start signal for each line, a value "0" is set in the density counter (C2) 109, and the halftone control unit 5 compares the data of a line obtained from the above-mentioned line memories (R2A, R2B) with the value and transfers, to the input terminal 120*b*, serial data for energizing only the elements only positions satisfying conditions [input data (R2A)]≧0 and [input data (R2B)]>0. Subsequently the count of the density counter (C2) 109 is stepwise increased to effect comparisons [input data (R2A)]≧1 and [input data (R2B)]>1, [input data (R2A)]≧2 and [input data (R2B)]>2, . . . , in a similar manner. The data readout from the line memories (R2A, R2B) 104 is terminated upon completion of the serial data transfer to the data input terminal 120*b* when the value of the density counter reaches "27".

The amount of energy supplied to the heat generating element 115 of the overlapped drive block is also controlled by the data of the temperature compensation ROM 108, and a corresponding strobe signal is supplied to the strobe input terminal 119*b* of the head driving circuit. However the data of the strobe pulse for the overlapped drive block are different from those for the divided blocks A, B. Though not illustrated, the ROM 108 is divided into two areas, respectively for the data of the divided blocks A, B and those of the overlapped drive block. The energizing operation of the heat generating element 115 by the data supplied to the head driving circuit will not be explained since it is same as that in the divided blocks A, B.

In the following there will be explained the method of data conversion by the data conversion circuit 3.

Figure 21:
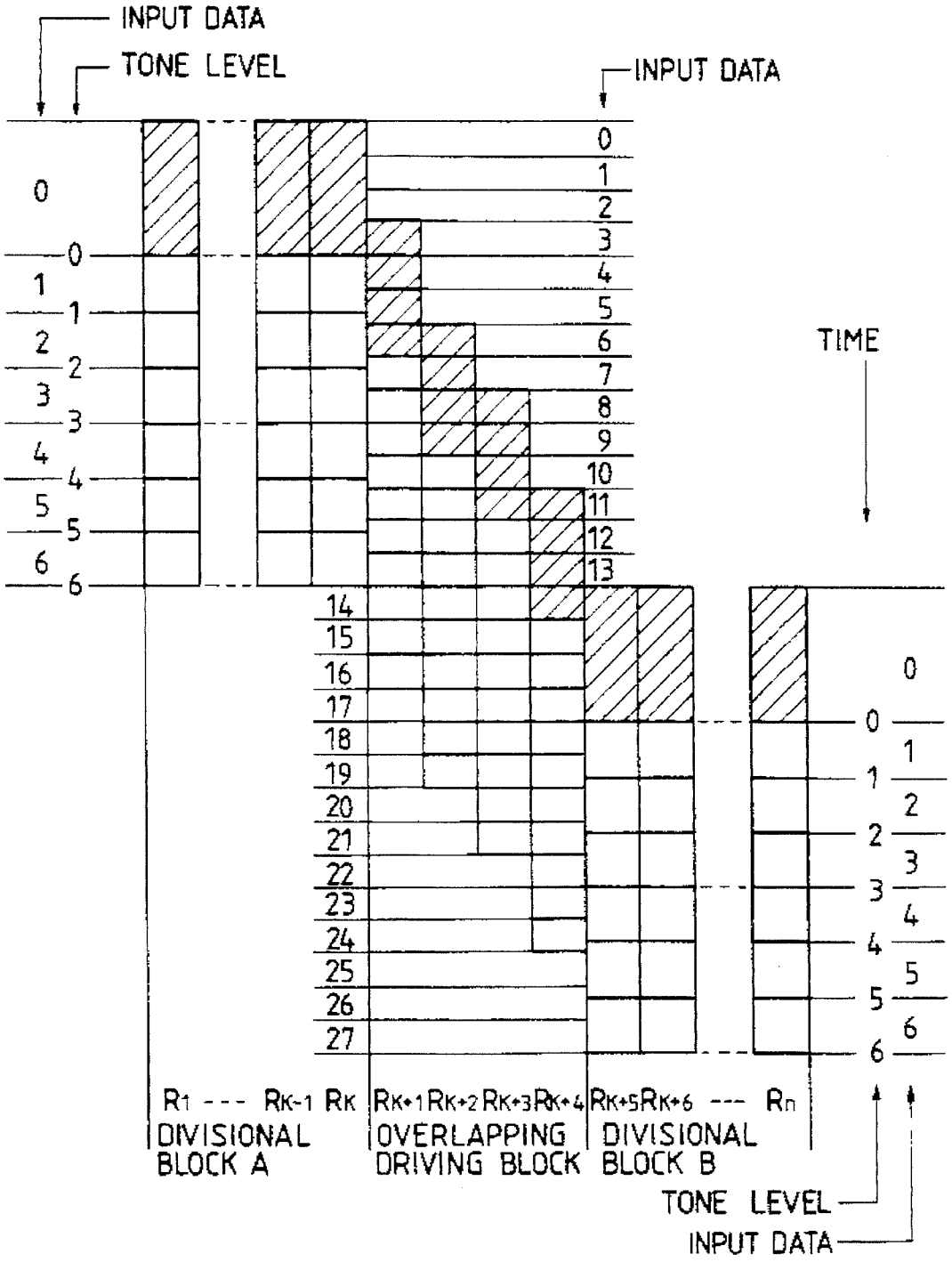
FIG. 21 is a timing chart showing an example of pulse application in heat generating elements in solid black printing.

FIG. 21 is a timing chart showing the pulse application to the heat generating elements of the present embodiment the in case of solid black printing, wherein the abscissa indicates the positions of the heat generating elements, while the ordinate indicate time and density levels.

In the present embodiment, the elements are divided into 3 blocks, and the overlapped drive block composed of four elements at the boundary can be energized simultaneously with each of the divided blocks A, B. The drive process for the divided block A is called the first pulse applying process, and that for the block B is called the second pulse applying process. Also the heat generating elements are numbered, from left to right, as $R_1$–$R_k$ in the left block A, $R_{k+1}$–$R_{k+4}$ in the overlapped drive block, and $R_{k+5}$–$R_n$ in the right block B.

At first there will be explained the case of solid black printing, in which all the elements record with the level "6".

At first the data of the first and second pulse applying processes are respectively stored in the line memories (W1) 140-1 and (W3) 140-3. The overlapped drive block receives pulses both in the first and second pulse applying processes, and the recording data are stored in the line memory (W2A) 140-2 while the recording inhibition data are stored in the line memory (W2B) 140-2. Thus, the in case of solid black printing, the line memory (W1) 140-1 stores data "6" for all the elements $R_1$–$R_k$, the line memory (W2A) 140-2 stores data "16, 19, 21, 14" respectively for the elements $R_{k+1}$–$R_{k+4}$, the line memory (W2B) 140-2 stores data "3, 6, 8, 11" respectively for the elements $R_{k+1}$–$R_{k+4}$, and the line memory (W3) 140-3 stores data "6" for the elements $R_{k+5}$–$R_n$.

Then the data are repeatedly read from the line memory (R1) 140-1 from the level "0" to "6" as explained above, and the first pulse applying process is conducted for effecting the recording of the divided block A. Subsequently the data are repeatedly read from the line memory (R3) 140-3 from the level "0" to "6" as explained before, and the second pulse applying process is conducted for effecting the recording of the divided block B. The overlapped drive block functions from the first to the second pulse applying process, and the timing of pulse application for each element is determined by the combination of the data of the line memories (R2A, R2B) 140-2. The timings for the elements of the overlapped drive block are selected in such a manner that the difference in timing between the blocks A and B is smoothly connected. Since the overlapped drive block contains fewer elements than in the blocks A and B, the time required for data transfer can be made quite short. Consequently the duration of the strobe pulse can be kept short, and the data can be finely divided.

The data preparation is conducted for example in the following manner. The total time for recording with the maximum density is divided by the number of elements in the overlapped drive block plus one, and the timing of pulse application between the blocks A and B is displaced in succession according to the value obtained by the division. Since the pulse duration of the strobe pulse in the overlapped drive block is shortened, it is possible to make the pulse duration of the block substantially equal to that in the blocks A, B. The solid black recording signals of the present embodiment are transferred to the thermal head through the above-explained operations.

Figure 22:
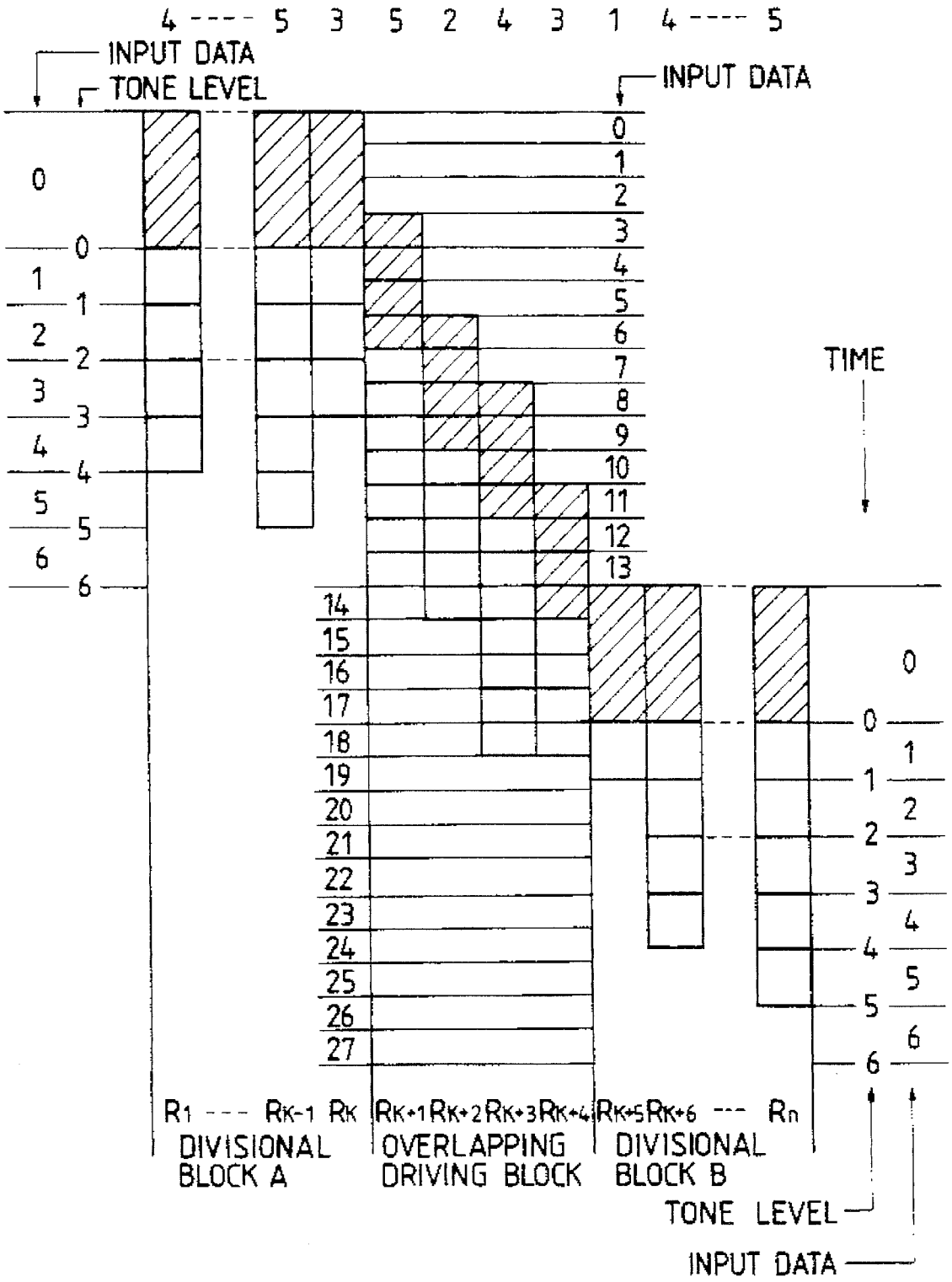
FIG. 22 is a timing chart showing an example of pulse application in heat generating elements at image data printing in the sixth embodiment.

FIG. 22 is a timing chart of the pulse application to the heat generating elements in response to ordinary image data.

Figure 23:
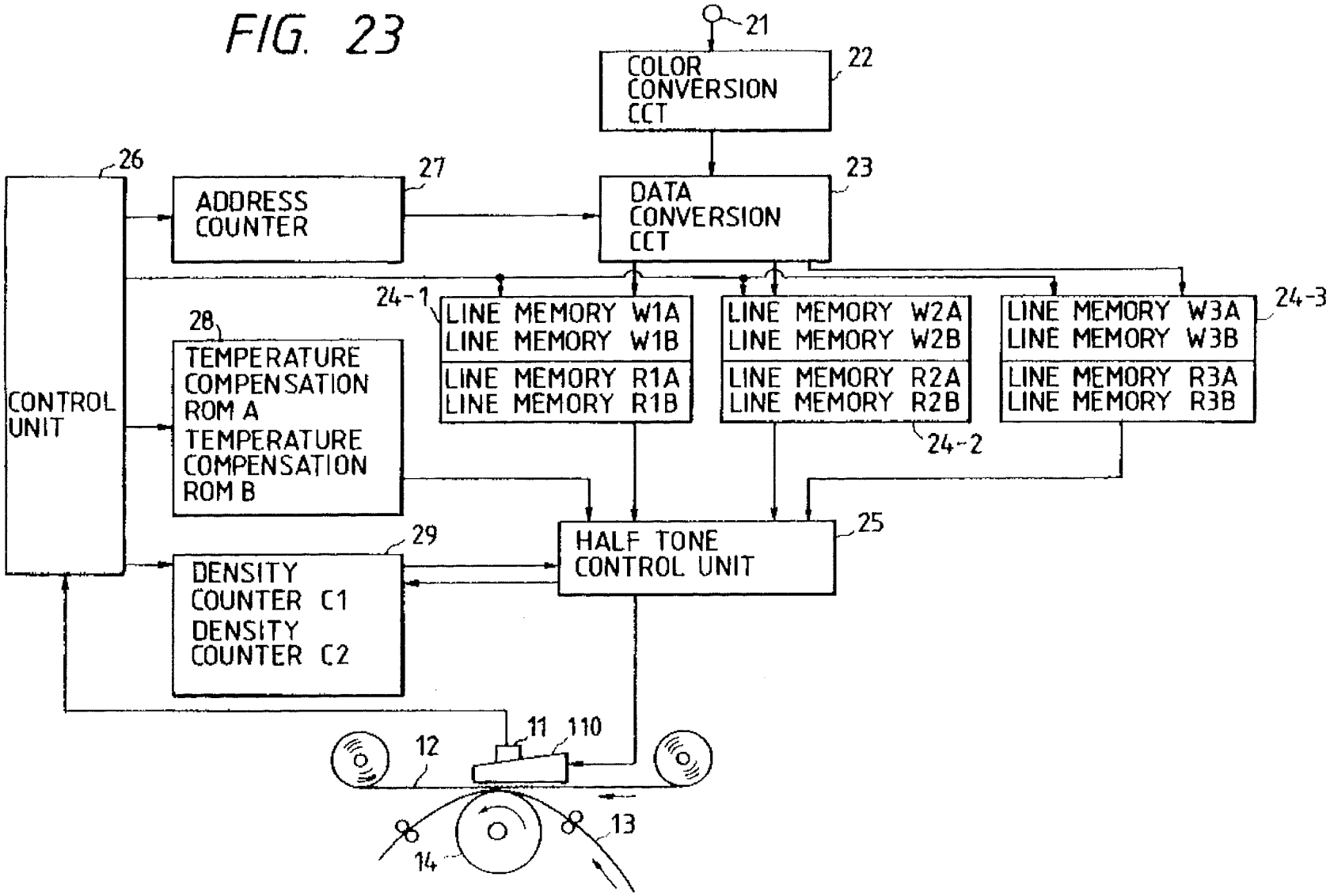
FIG. 23 is a block diagram of a seventh embodiment.

FIG. 23 shows a seventh embodiment of the present embodiment, wherein components 11–14 and 110 are same as those shown in FIG. 19. There are also shown a color image input terminal 21 separated for R, G and B signals; a color conversion circuit 22 for converting the B, G, R signals into Y, M, C signals; a data conversion circuit 23 for converting data according to the position of the heat generating element, more specifically dividing the data of a line into two pulse applying processes in the blocks A, B, and the data into recording data and recording inhibition data in the overlapped drive block; line memories 24 for storing thus divided data; a halftone control unit 25 for controlling the energy supplied to the thermal head 10 in order to reproduce the halftone of the color image; a control unit 26 for controlling the entire thermal printer; an address counter 27 for counting the position of the heat generating element; a temperature compensation ROM 28 storing data for determining the density level according to the color of the ink sheet and the temperature around the thermal head; a density counter 9 for counting the number of strobe signals; a thermal head 10; a temperature detector 11 for detecting the head temperature; an ink sheet 12; a receiving sheet 13; and a platen roller 14.

The driving unit for the thermal head is provided on the head 10, and is constructed in the same manner as shown in FIG. 20.

In the following there will be explained the function of the present embodiment.

The B, G, R signals from a color image memory (not shown) are received, in succession, by the input terminal 21 corresponding to the order of printing of Y, M and C, and are respectively converted into Y, M, C signals in the color conversion circuit 22, which sends image data, by units of print lines, to the data conversion circuit 23.

In the divided block A, the data of a line are divided, according to predetermined proportions, for each element designated by the address counter 27, and are respectively stored in two line memories (W1A, W3B) 24-1, 24-3. Then the data of a line are read, by a number of times corresponding to the number of levels (4 times in the present embodiment) from the line memory (R1A) 24-1 and are transferred to the halftone control unit 25. Then similar operations are conducted, by a number of times corresponding to the number of times (3 times in the present embodiment) on the line memory (R1B) 24-1. Simultaneous with the print start signal for each line, a value "3", indicating the number of levels, is set in the density counter (C1) 29, and the halftone control unit 25 compares the data of a line obtained from the line memory (R1A) 24-1 with the value and transfers, to the data input terminal 120*a*, serial data for energizing the elements only at positions satisfying a condition [input data]≧3. Subsequently the count of the density counter (C1) 9 is stepwise decreased for effecting comparisons [input data]≧2, [input data]≧1 in succession.

The data readout from the line memory (R1A) 24-1 is terminated when the value of the density counter (C1) 29 reaches "1". Then the data of a line are read from the line memory (R2A) 24-2, and the data input terminal 120*a* is given serial data for energizing the elements only at positions satisfying a condition [input data]≧0. The density counter (C1) 29 is switched to the upcounting mode, and comparisons are conducted similarly in the order of [input data]≧1, [input data]≧2, . . . , and data transfer of a line of 7 levels is completed when data satisfying [input data]≧3 are transferred.

The amount of energy supplied to the heat generating resistor element 115 is controlled according to the data of the temperature compensation ROM (A) 28, and a corresponding strobe signal is supplied to the strobe input terminal 119*a* of the head driving circuit. Strobe signals are also divided, like the data transfer, into two modes, and pulses of a number corresponding to the number of levels (7 in total ) are transferred.

The data signals introduced into the head driving circuit through the above-explained operations are stored in the shift register 117*a*, then latched and simultaneously supplied, by a level at a time, to the AND gates $A_1$–$A_k$ for logical multiplication with the strobe signal, whereby the selected heat generating elements are energized for the pulse duration of the strobe signal. This operation is repeated 7 times in total in two modes, thereby obtaining an image print of a line of 7 levels.

The sublimable or fusible ink coated on the ink sheet 12 sublimes or is fused by the thermal energy of the heat generating elements 115, and is transferred onto the receiving sheet 13 to form an image thereon.

The divided block B will not be explained as the structure and function thereof are similar to those of the block A.

In the following there will be explained the recording operation in the overlapped drive block.

The overlapped drive block is controlled independently from the divided blocks A, B. The data of a line are read from the line memories (R2A, R2B) 124-2 by a number of times corresponding to the number of levels (28 times in the present embodiment), and are transferred to the halftone control unit 25 for effecting the recording.

The printing operation of a line is conducted in the following manner. Simultaneous with the print start signal of each line, a value "0" is set in the density counter (C2) 29, and the halftone control unit 25 compares the data of a line from said line memories (R2A, R2B) with said value and transfers, to the input terminal 120*b*, serial data for energizing only the elements which are in positions satisfying the conditions [input data (R2A)]≧0 and [input data (R2B)]≦0. Subsequently the count of the density counter (C2) 29 is stepwise increased to effect comparisons [input data (R2A)]≧1 and [input data (R2B)]>1; [input data (R2A)]≧2 and [input data (R2B)]>2, . . . in a similar manner. The data readout from the line memories (R2A, R2B) 24-2 is terminated upon completion of the serial data transfer to the data input terminal 120*b* with a value "27" in the density counter (C2) 29.

The amount of energy supplied to the heat generating resistor elements 115 of the overlapped drive block is also controlled according to the data of the temperature compensation ROM (B) 28, and corresponding strobe signals are transferred to the strobe input terminal 119*b* of the head driving circuit. However the data of the strobe pulse for the overlapped drive block are different from the ordinary data of the divided blocks A, B. Though not illustrated, the temperature compensation ROM 28 is divided into two areas, respectively for the data of the divisional driving units A, B and those of the overlapped drive block.

The energizing operation of the heat generating elements 115 according to the data entered into the head driving circuit will not be explained as it is similar to the operation in the divided blocks A, B.

In the following there will be explained the method of data division in the data conversion circuit 23.

Figure 24:
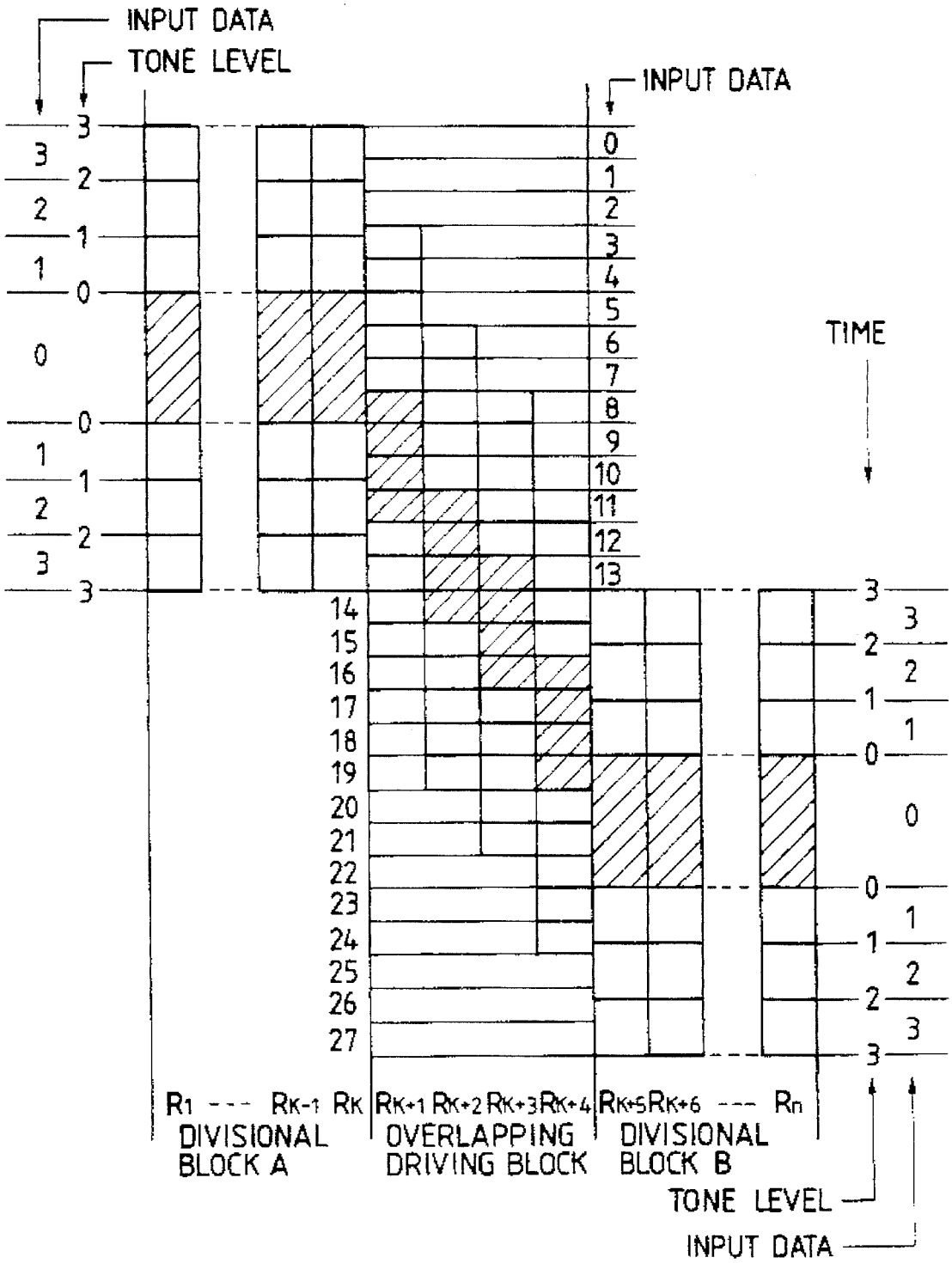
FIG. 24 is a timing chart showing an example of pulse application in heat generating elements in solid black printing in the seventh embodiment.

FIG. 24 is a timing chart of pulse application to the heat generating elements of the present embodiment in the case of solid black printing, wherein the abscissa indicates the positions of the heat generating elements, while the ordinate indicates time and density levels. In the present embodiment, the elements are divided into three blocks, and the overlapped drive block consisting of four elements at the boundary can be energized simultaneously with each of other blocks A and B. The pulse application for the divided block A is called the first pulse applying process, and that for the divided block B is called the second pulse applying process. The heat generating elements are numbered from left to right, as $R_1$–$R_k$ in the left block A; $R_{k+1}$–$R_{k+4}$ in the overlapped drive block; and $R_{k+5}$–$R_n$ in the right block B.

At first there will be explained the case of solid black printing in which all the elements record the level "6".

Data of the modes 1 and 2 for the first pulse applying process are respectively stored in the line memories (W1A) 24-1 and (W1B) 24-1, and data of the modes 1 and 2 for the second pulse applying process are respectively stored in the line memories (W3A) 24-3 and (W3B) 24-3. The overlapped drive block receives pulses over the first and second pulse applying processes, and the recording data are stored in the line memory (W2A) 24-2, while the recording inhibition data are stored in the line memory (W2B) 24-2. In case of solid black printing, the line memory (W1A) 24-1 stores data "3" for all the elements $R_1$–$R_k$, and the line memory (W1B) 24-1 also stores data "3". The line memory (W2A) 24-1 stores data "16, 19, 21, 14" while the line memory (W2B) 24-2 stores data "3, 6, 8, 11" for the elements $R_{k+1}$–$R_{k+4}$. The line memory (W3A) 24-3 stores data "3" for all the elements $R_{k+5}$–$R_n$, and the line memory (W3B) 24-3 also stores data "3".

Then the first pulse applying process for printing the divided block A is conducted by reading data from the line memory (R1A) 24-1 from the level "3" to "0" in succession as explained above, and reading data from the line memory (R1B) 24-1 from the level "0" to "3". Subsequently the second pulse applying process for printing the divided block B is conducted by reading data from the line memory (R3A) 24-3 from the level "3" to "0" and then reading the data from the line memory (R3B) 24-3 from the level "0" to "3". The overlapped drive block functions from the first to second pulse applying process, and the timing of pulse application to each element is determined by the combination of the data of the line memories (R2A, R2B) 24-2. The timing for elements of the overlapped drive block are selected in such a manner that the difference in timing between the blocks A and B is smoothly connected. Since the overlapped drive block contains fewer elements than in the blocks A and B, the time required for data transfer can be made very short. Consequently the duration of the strobe pulse can be made short, and the data can be finely divided.

The data preparation is conducted for example in the following manner. The total time for recording with the maximum density is divided by the number of elements in the overlapped drive block plus one, and the timing of pulse application between the blocks A and B is displaced in succession according to the value obtained by the division. Since the pulse duration of the strobe pulse in the overlapped drive block is shortened, it is possible to make the pulse duration of the block substantially equal to that in the blocks A, B. The solid black printing signals of the present embodiment are transferred to the thermal head through the above-explained operations.

Figure 25:
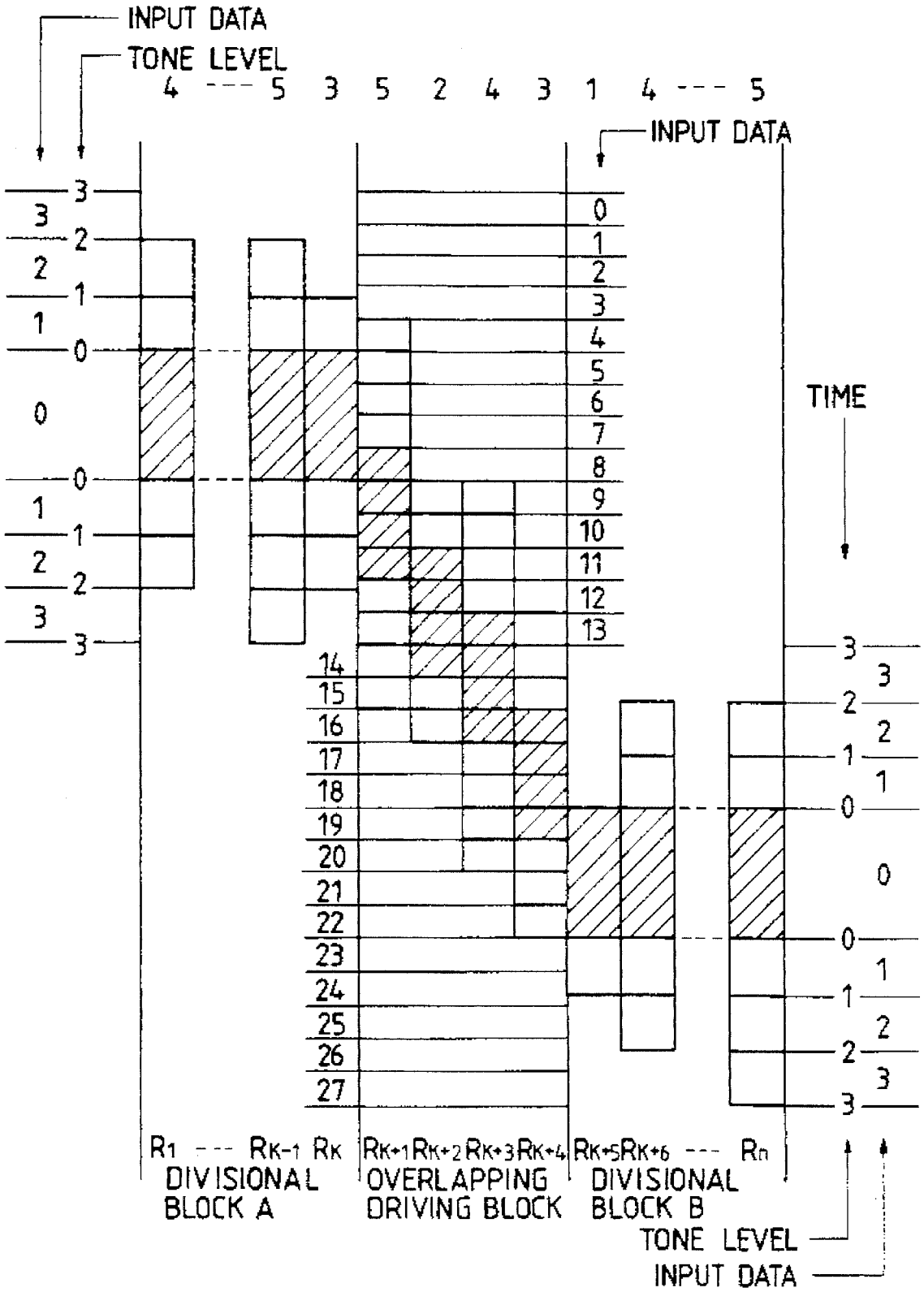
FIG. 25 is a timing chart showing an example of pulse application in heat generating elements in image data recording in the seventh embodiment.

FIG. 25 is a timing chart of the pulse application to the heat generating elements in response to ordinary image data.

As explained in the foregoing, in the present embodiment, plural heat generating elements are arranged in an array and are divided into plural blocks. Among three consecutive blocks, those which are not mutually adjacent are not energized simultaneously, and the central block is driven independently and simultaneously with the non-adjacent blocks. Also the heat generating elements constituting the central block are energized with time differences in such a manner that the time difference between the pulse applied to an element and the pulse applied to the adjacent element does not exceed the maximum pulse duration applied to the elements, whereby an image of high quality without division lines can be obtained.

Besides, a density level of about half of the maximum density level is taken as the zero level, and the density is increased before and after the recording time of said zero level, so that an image of high quality without division lines can be obtained.

The 1st and 7th embodiments have described thermal transfer recording apparatus, but the present invention is not limited to such an apparatus and can achieve the desired objective, for example, in an ink jet recording apparatus.

Among the ink jet recording methods, the present invention provides excellent effect in the bubble jet recording method and an apparatus employing such method, because such method can achieve a high density and a high definition in recording. The present invention is particularly effective in a bubble jet recording method employing plural dot recording for a pixel.

The representative structure and working principle of such recording method are preferably those disclosed in the U.S. Pat. Nos. 4,723,129 and 4,740,796. This recording method is applicable to so-called on-demand recording or continuous recording, but is particularly effective in the on-demand recording, since a bubble can be formed in the liquid (ink) in 1:1 correspondence to the drive signal, by giving at least a drive signal, corresponding to the recording information and inducing a rapid temperature rise exceeding nucleus boiling, to an electrothermal converter (corresponding to the heat generating element mentioned above) positioned in a sheet or a liquid path holding said liquid, thereby causing the converter to generate thermal energy and inducing film boiling on a thermal action plane of the recording head. The growth of bubble, generated by film boiling, causes said liquid to be discharged from a discharge opening, thereby forming at least a liquid droplet. The drive signal is preferably shaped as a pulse, since the expansion and contraction of bubble is achieved in a highly responsive manner, thereby causing liquid discharge with excellent response. Such pulse-shaped drive signal is of the type disclosed in the U.S. Pat. Nos. 4,463,359 and 4,345,262. Further improved recording can be obtained by employing the teachings of U.S. Pat. No. 4,313,124 concerning the temperature rise rate of thermal action plane.

As regards the structure of the recording head, the present invention includes not only those composed of combinations of discharge openings, liquid paths and electrothermal converters (those with linear or rectangularly liquid paths) as disclosed in the above-mentioned patents, but also those in which the thermal action area is positioned at a bent path area, as disclosed in U.S. Pat. Nos. 4,558,333 and 4,459,600. In addition the present invention is effective for a structure of the type disclosed in Japanese Laid-Open Patent Sho 59-123670 in which the discharge opening is composed of a slit which is commonly used for plural electrothermal converters, or the structure disclosed in Japanese Laid-Open Patent Sho 59-138461 in which an opening for absorbing the pressure wave of thermal energy is provided corresponding to the discharge opening. The present invention enables secure and efficient recording regardless of the structure of the recording head.

Figure 27:
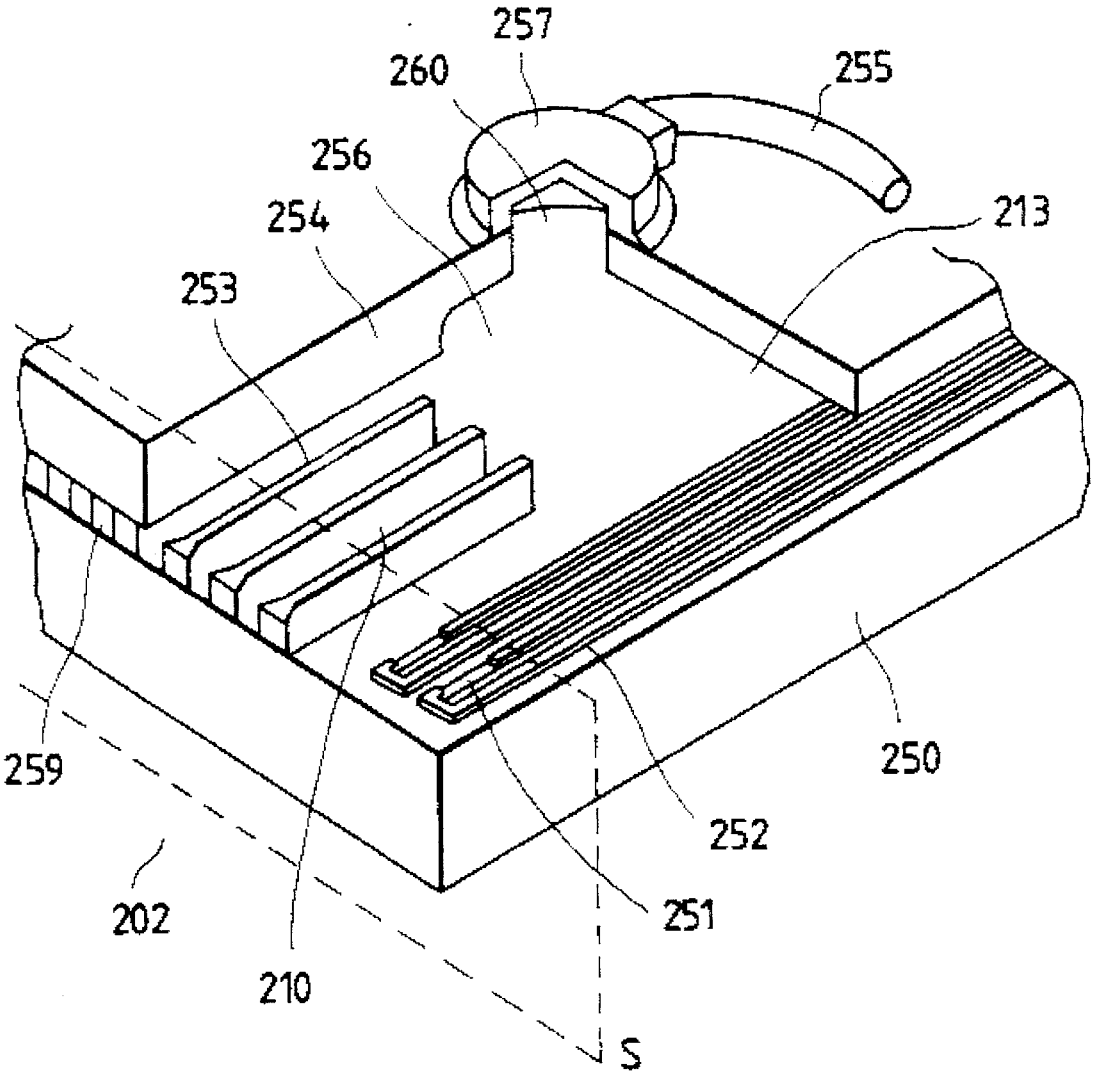
FIG. 27 is a perspective view of a multi-nozzle ink jet recording head.
Figure 28:
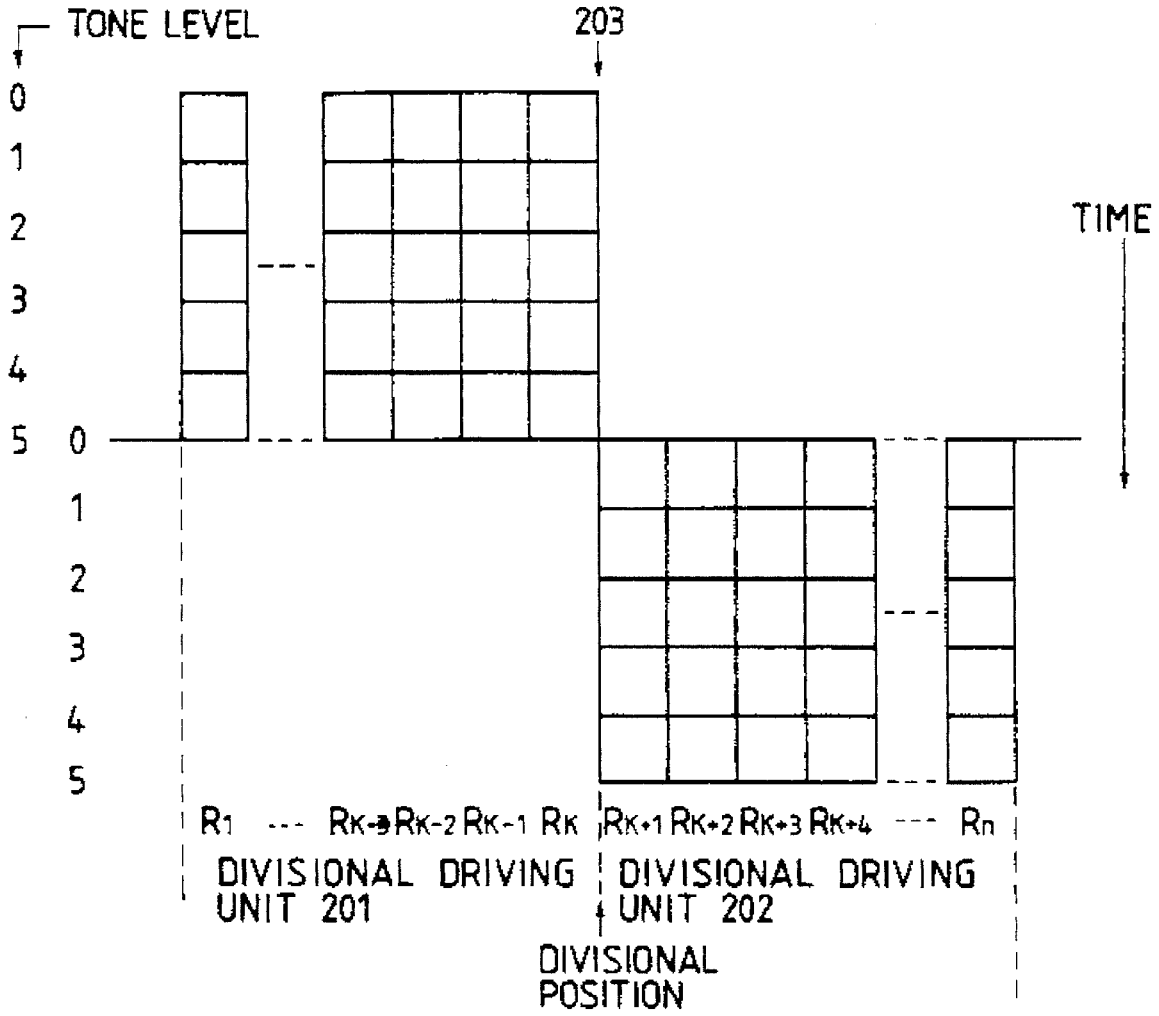
FIG. 28 PRIOR ART
FIG. 28 is a timing chart showing an example of pulse application in heat generating elements in conventional solid black printing.

FIG. 27 is a perspective view of a multi-nozzle ink jet recording head in which the present invention is applicable. A recording head 202 is principally composed of electrothermal converters 251; electrodes 252; liquid path walls 253 formed, for example, of photosensitive resin; and a cover plate 254, for example, glass, formed on a silicon substrate 250 utilizing the known processes for producing semiconductor devices such as etching, evaporation, sputtering etc. Ink 213 is supplied from an ink reservoir (not shown) to a common liquid chamber 256 of the recording head 202, through an ink supply tube 255, a connector 257 therefor and an ink supply opening 260.

The ink 213 is supplied by capillary action from the ink reservoir to the common liquid chamber 256, then to liquid paths 210, and remains in a stable state by forming a meniscus at an ink discharge opening 259 formed at the end of each liquid path 210. When the electrothermal converter 251 generates heat in response to applied electric current, the ink 213 causes membrane boiling phenomenon by rapid heating, thus generating a bubble therein. By the expansion and contraction of the thus generated bubble, the ink is discharged from the ink discharge opening 259 to form a flying droplet.

The above-explained structure allows one to easily produce a multi-nozzle ink jet recording head having 128 or 256 nozzles at a high density such as 16 nozzles/mm, or an even longer head for a full-line printer, with satisfactory productivity.

In such recording heads, similar effects as in the case of thermal heads can be obtained by energizing the electrothermal converters 251 in the manner explained before according to the present invention.

The recording apparatus of the present invention is preferably provided with recovery means for the recording head or auxiliary means in order to stabilize the effect of the present invention. More specifically, such means include capping means, cleaning means, pressurizing or suction means for the recording head, preliminary heating means utilizing the electrothermal converters and/or other heating devices, and execution of preliminary ink discharge different from the ink discharge for recording.

Furthermore, the recording method of the present invention and the recording apparatus utilizing said method may be applied not only to an image output terminal for an information processing apparatus such as computer but also to a copying apparatus combined with an image reader or a facsimile apparatus capable of information transmission and reception.

What is claimed is:

1. A recording apparatus comprising:

a recording head, said recording head having a plurality of heat generating elements, said heat generating elements being arranged in a linear array which is divided into a plurality of divided blocks;

drive means for driving said plural heat generating elements in said plurality of divided blocks; and control means for controlling said drive means in such a manner that, in any consecutive three of said divided blocks, a non-adjacent two of said three divided blocks are not simultaneously driven, a central one of said three divided blocks is driven independently of and simultaneously with each of said two non-adjacent blocks, and the heat generating elements constituting said central divided block are driven by application of pulses with a mutual time difference;

wherein a time difference between a pulse application to a one of said heat generating elements and a pulse application to an adjacent said heat generating element does not exceed a maximum pulse duration to said heat generating elements.

2. An apparatus according to claim 1, wherein said recording head is constructed to effect recording by transferring an ink of an ink sheet by heat generated by said heat generating elements.

3. A device according to claim 1, wherein said recording head is constructed to effect recording by discharging an ink of an ink sheet, the discharging resulting from an expansion of bubbles generated by boiling of said ink, the boiling resulting from heat generated by said heat generating elements.

4. A recording apparatus according to claim 1, wherein said drive means drives said heat generating elements for a time period which is variable.

5. A recording apparatus according to claim 4, wherein said time period is varied according to an image density data.

6. A recording apparatus according to claim 1, wherein said control means controls said drive means so that a first of said two non-adjacent blocks is driven in a first process and a second of said two non-adjacent blocks is driven in a second process, and wherein said control means determines energy to be supplied to said central divided block in said first process and said second process in such a manner that said energy generates heat corresponding to an image data corresponding to said central divided block.

7. A recording apparatus according to claim 1, wherein said control means controls said drive means so that an amount of energy supplied to each of said heat generating elements in said central divided block is substantially equal to an amount of energy supplied to each said heat generating element in said two non-adjacent blocks.

8. A recording apparatus according to claim 1, wherein said control means controls said drive means in a first process for setting a first recording data for said central divided block and driving said central divided block simultaneously with a first of said two non-adjacent blocks and in a second process for setting a second recording data for said central divided block and driving said central divided block simultaneously with a second of said two non-adjacent blocks, and wherein a sum of said first recording data and said second recording data is selected to be equal to an image data for said central divided block.

* * * * *

UNITED STATES PATENT AND TRADEMARK OFFICE

CERTIFICATE OF CORRECTION

PATENT NO. : 5,539,433

DATED : July 23, 1996

INVENTOR(S) : JUN KAWAI ET AL.

It is certified that error appears in the above-identified patent and that said Letters Patent is hereby corrected as shown below:

COLUMN 3

Line 7, "FIG.26-1" should read --FIGS. 26-1--.
Line 57, "DATA:" should read --DATA;--.

COLUMN 4

Line 5, "case" should read --the case--.
Line 15, "signal" should read --signals--.

COLUMN 5

Line 8, "elements R1-R10" should read --elements $R_1$-$R_{10}$--.
Line 21, "cases" should read --the cases--.

COLUMN 6

Line 64, close up right margin.
Line 65, close up left margin.

COLUMN 7

Line 38, "are" should read --enable one--.
Line 45, "right" should read --right,--.

UNITED STATES PATENT AND TRADEMARK OFFICE

CERTIFICATE OF CORRECTION

PATENT NO. : 5,539,433

DATED : July 23, 1996

INVENTOR(S) : JUN KAWAI ET AL.

It is certified that error appears in the above-identified patent and that said Letters Patent is hereby corrected as shown below:

COLUMN 8

Line 1, "a" (first occurrence) should be deleted.
Line 3, "a" should be deleted.
Line 6, "density]," should read --density--.
Line 7, "counter 9," should read --counter 9],--.
Line 7, "head 11." should read --head 10.-- and "a" should be deleted.
Line 8, "head 11," should read --head 10,--.
Line 9, "a" should be deleted.
Line 10, "a" should be deleted.
Line 12, "counter 9s" should read --counter 9--.
Line 13, "the" (first occurrence) should be deleted.
Line 18, "head 11," should read --head 10,--.
Line 19, "head 11." should read --head 10.--.
Line 26, "11" should read --10--.

COLUMN 9

Line 6, "the" should read --this--.
Line 7, "relation" should read --relationship--.

COLUMN 10

Line 12, "elements 14" should read --elements 15--.
Line 56, "a" (first occurrence) should be deleted.

UNITED STATES PATENT AND TRADEMARK OFFICE

CERTIFICATE OF CORRECTION

PATENT NO. : 5,539,433

DATED : July 23, 1996

INVENTOR(S) : JUN KAWAI ET AL.

It is certified that error appears in the above-identified patent and that said Letters Patent is hereby corrected as shown below:

COLUMN 11

Line 6, "head 11." should read --head 10.--.
Line 7, "head 11," should read --head 10,--.
Line 10, "the" should be deleted.
Line 12, "the" (first occurrence) should be deleted.
Line 17, "head 11," should read --head 10,-- and "data" should read --the data--.
Line 18, "11." should read --10.--.
Line 20, "affirmative" should be deleted.
Line 21, "head 11" should read --head 10--.
Line 26, "head 11" should read --head 10-- and "a" should be deleted.
Line 28, "the" should be deleted.
Line 30, "head 11" should read --head 10--.
Line 35, "head 11" should read --head 10--.
Line 58, "head 11" should read --head 10--.

COLUMN 12

Line 1, "this" should read --the--.
Line 44, "said" should read --this--.
Line 66, "This" should read --These--.

UNITED STATES PATENT AND TRADEMARK OFFICE

CERTIFICATE OF CORRECTION

PATENT NO. : 5,539,433

DATED : July 23, 1996

INVENTOR(S) : JUN KAWAI ET AL.

It is certified that error appears in the above-identified patent and that said Letters Patent is hereby corrected as shown below:

COLUMN 13

Line 25, "cess" should read --cess,--.
Line 44, "generating elements $R_{k+1}$, $R_{k+2}$, $R_{k+3}$, $R_{k+4}$" should be deleted.
Line 45, "of the" should be deleted and "heat" should read --heat generating elements $R_{k+1}$, $R_{k+2}$, $R_{k+3}$, $R_{k+4}$ of the--.

COLUMN 14

Line 22, "said" should read --the--.
Line 35, "an" should read --a--.
Line 36, "unrepresented" should be deleted and "memory," should read --memory (not shown),--.
Line 50, "relationship" should read --the relationship--.
Line 59, "data≥ holds," should read --data] ≥0 holds,--.

COLUMN 16

Line 36, "said" should read --the--.
Line 48, "as those" should be deleted.

COLUMN 17

Line 6, "steps "0"" should read --sets "0"--.
Line 59, "an unrepresented" should read --a-- and "memory," should read --memory (not shown),--.

UNITED STATES PATENT AND TRADEMARK OFFICE

CERTIFICATE OF CORRECTION

PATENT NO. : 5,539,433

DATED : July 23, 1996

INVENTOR(S) : JUN KAWAI ET AL.

It is certified that error appears in the above-identified patent and that said Letters Patent is hereby corrected as shown below:

COLUMN 18

Line 1, "addition" should read --addition,--.
Line 19, "line" should read --a line--.

COLUMN 19

Line 5, "reed" should read --need--.
Line 25, "only" (second occurrence) should read --which are in--.
Line 26, "[input data (R2B)]>0." should read --[input data (R2B)]≤0.--.
Line 29, "[input data (R2B)]>1," should read --[input data (R2B)]≤1,--
Line 30, "[input data (R2B)]>2," should read --[input data (R2B)]≤2,--.
Line 54, "indicate" should read --indicates--.

COLUMN 20

Line 6, close up right margin.
Line 7, close up left margin and "the in" should read --in the--.

COLUMN 22

Line 20, "[input data (R2B)]>1"; should read --[input data (R2B)]≤1;--.
Line 21, "[input data (R2B)]>2," should read --[input data (R2B)]≤2,--.

UNITED STATES PATENT AND TRADEMARK OFFICE

CERTIFICATE OF CORRECTION

PATENT NO. : 5,539,433

DATED : July 23, 1996

INVENTOR(S) : JUN KAWAI ET AL.

It is certified that error appears in the above-identified patent and that said Letters Patent is hereby corrected as shown below:

COLUMN 23

Line 64, "1st and 7th" should read --1st to 7th--.

COLUMN 24

Line 16, "nucleus" should read --nucleate--.
Line 18, "said" should be deleted.
Line 22, "said" should be deleted.
Line 27, "Such" should read --Such a--.

COLUMN 25

Line 1, "membrane" should read --film--.

COLUMN 26

Line 10, "A device" should read --An apparatus--.

Signed and Sealed this

Seventeenth Day of December, 1996

*Attest:*

Bruce Lehman

BRUCE LEHMAN

*Attesting Officer*

*Commissioner of Patents and Trademarks*